US007041888B2

(12) United States Patent
Masuda

(10) Patent No.: US 7,041,888 B2
(45) Date of Patent: May 9, 2006

(54) FINGERING GUIDE DISPLAYING APPARATUS FOR MUSICAL INSTRUMENT AND COMPUTER PROGRAM THEREFOR

(75) Inventor: Hideyuki Masuda, Shizuoka-Ken (JP)

(73) Assignee: Yamaha Corporation, (JP)

( * ) Notice: Subject to any disclaimer, the term of this patent is extended or adjusted under 35 U.S.C. 154(b) by 0 days.

(21) Appl. No.: 11/032,513

(22) Filed: Jan. 10, 2005

(65) Prior Publication Data

US 2005/0172780 A1 Aug. 11, 2005

(30) Foreign Application Priority Data

Jan. 9, 2004 (JP) ..... 2004-004817

(51) Int. Cl.
*G10F 1/06* (2006.01)

(52) U.S. Cl. ..... 84/100

(58) Field of Classification Search ..... 84/600, 84/470 R, 477 R, 478, 480, 479 A, 483.1, 84/483.2, 484, 485 R
See application file for complete search history.

(56) References Cited

U.S. PATENT DOCUMENTS 6,380,473 B1 * 4/2002 Uehara ..... 84/609
6,423,893 B1 * 7/2002 Sung et al. ..... 84/645

FOREIGN PATENT DOCUMENTS

| | | | |
|---|---|---|---|
| JP | 1-314282 | A | 12/1989 |
| JP | 2000-3171 | A | 1/2000 |
| JP | 2000-112470 | A | 4/2000 |

* cited by examiner

*Primary Examiner*—Kimberly Lockett
(74) *Attorney, Agent, or Firm*—Rossi, Kimms & McDowell, LLP

(57) ABSTRACT

A fingering guide displaying apparatus is to guide a player or a learner how to finger wind musical instruments in playing. As most of wind musical instruments are transposing instruments, the fingering patterns are indicated for the respective notes on the music scores notated in the respective tonalities which are unique to the respective instruments. The apparatus stores a fingering pattern database representing fingering patterns for the respective available notes of various transposing instruments in the respective instrument tonalities, and a transposition value database representing, for each of the instrument tonalities, the pitch difference between the instrument tonality and the reference tonality. When music playing data expressed in the reference tonality are used for playing a transposing instrument, the playing data are converted to express the notes in the instrument tonality using the pitch difference value, and fingering patterns are also indicated in the instrument tonality.

17 Claims, 22 Drawing Sheets

Hardware Configuration

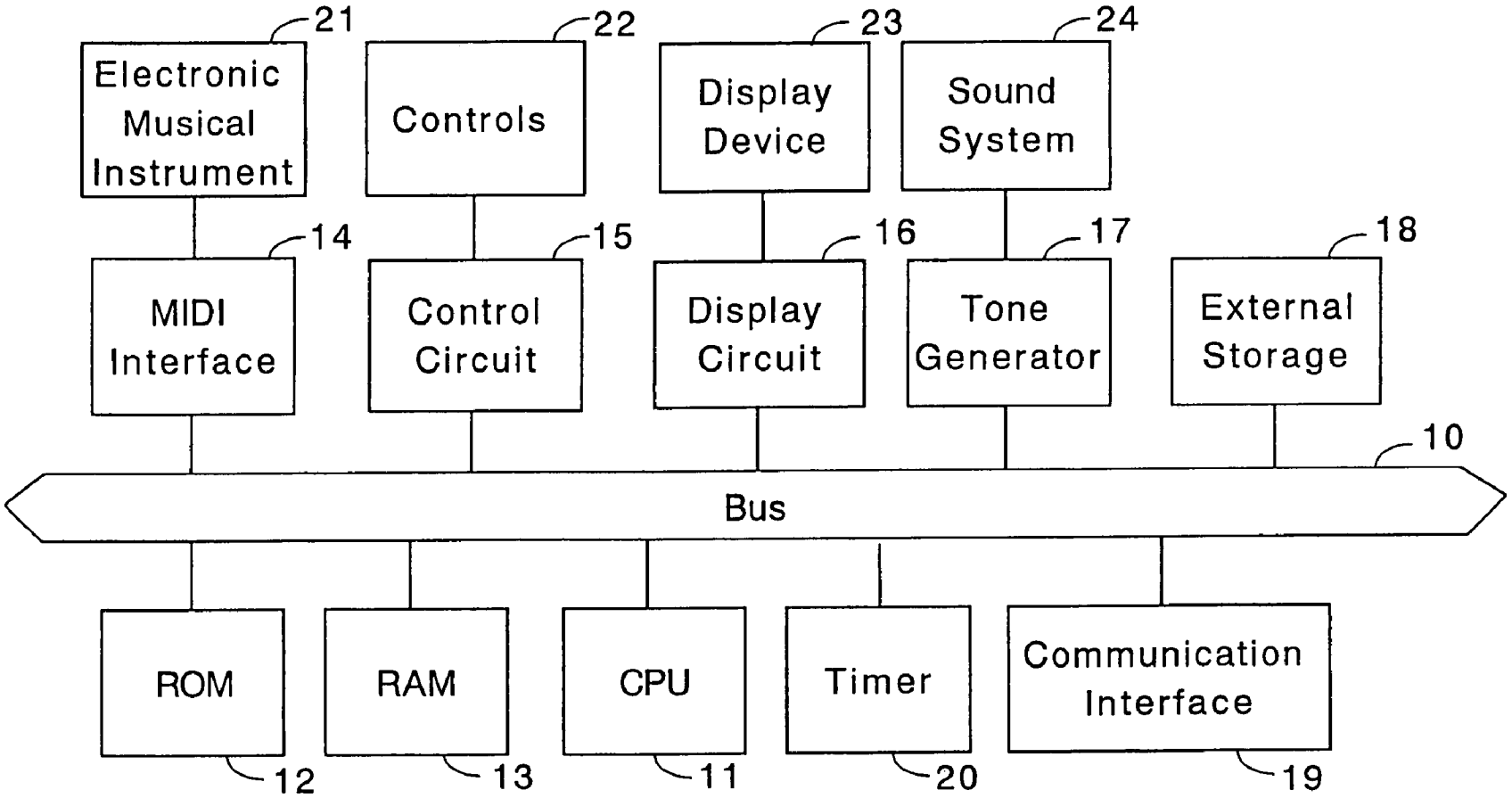
*Fig. 1* Hardware Configuration

*Fig.2* Transposition Value Database

| Musical Instrument | Instrument Tonality | Transposition Value |
|---|---|---|
| Trumpet | in B♭ | −2 |
| Clarinet | in B♭ | −2 |
| Horn | in F | −7 |
| Oboe | in C | 0 |
| Piccolo | in C | +12 |
| Soprano Saxophone | in B♭ | −2 |
| ⋮ | ⋮ | ⋮ |

*Fig.3* Fingering Pattern Database

| Notated Pitch | Fingering Pattern |
|---|---|
| C5 | "0" |
| C#5 | "12" |
| D5 | "1" |
| D#5 | "2" |
| E5 | "0" |
| ⋮ | ⋮ |

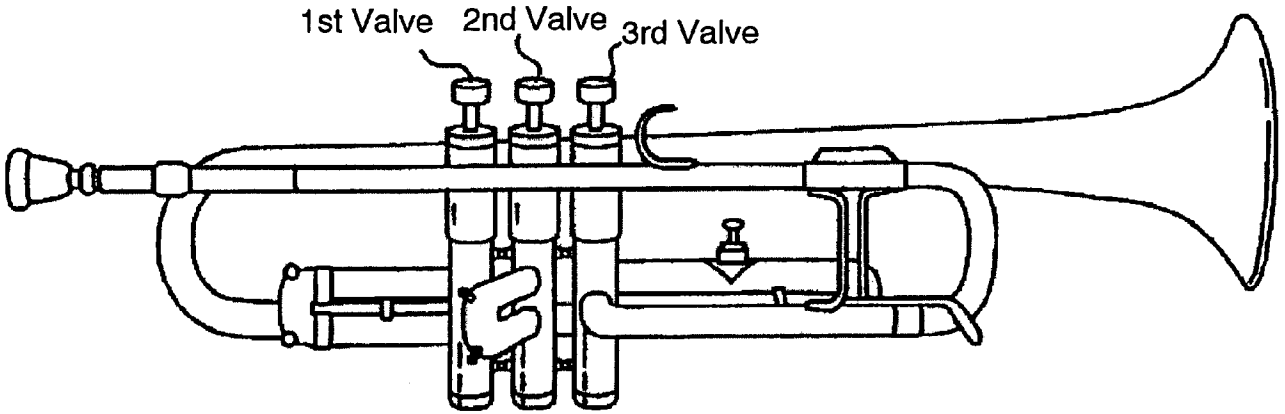
*Fig.4a* Trumpet at Rest
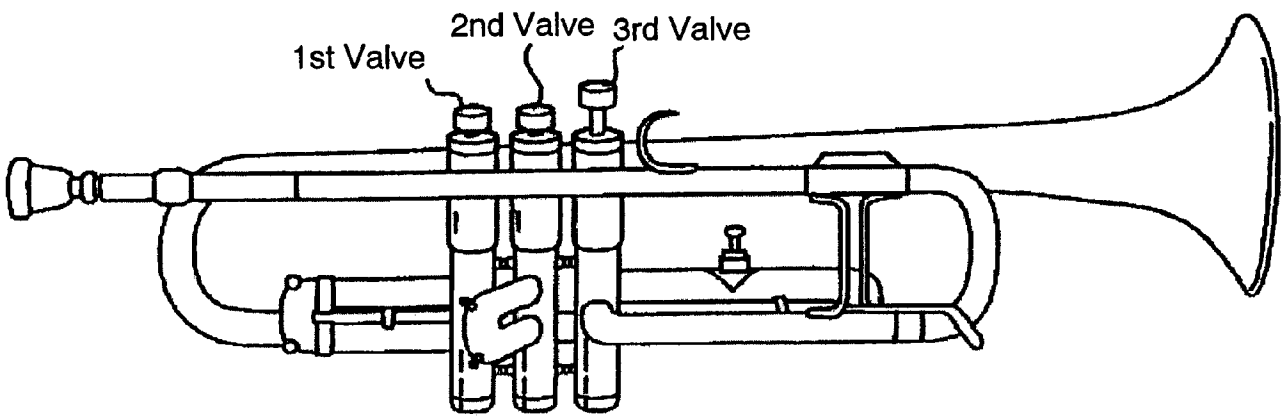
*Fig.4b* Trumpet as Fingered

*Fig. 5* Music Piece Information

Music Piece Information

| Logical Score Information | | | | Performance Information |
|---|---|---|---|---|
| Note Info | | Rest Info | Sign Info | |
| Duration | Pitch | | | |
| 2 | 0 | | Slur | Time Data |
| 1 | 2 | | | Key-On Event Data |
| 1 | 0 | | | Time Data |
| 0.5 | 4 | | | Key-Off Event Data |
| | | 1 | | Time Data |
| | | | | Key-On Event Data |
| 4 | 2 | | Tenuto | Time Data |
| | | | | Key-Off Event Data |
| ⋮ | | ⋮ | ⋮ | ⋮ |

*Fig. 6* Music Score Display Processing
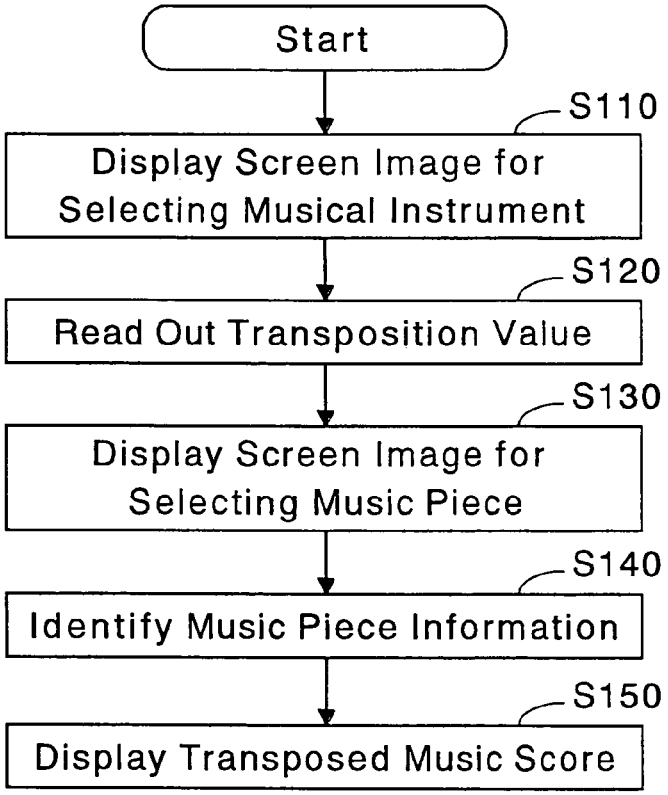

*Fig. 7* Fingering Display Processing
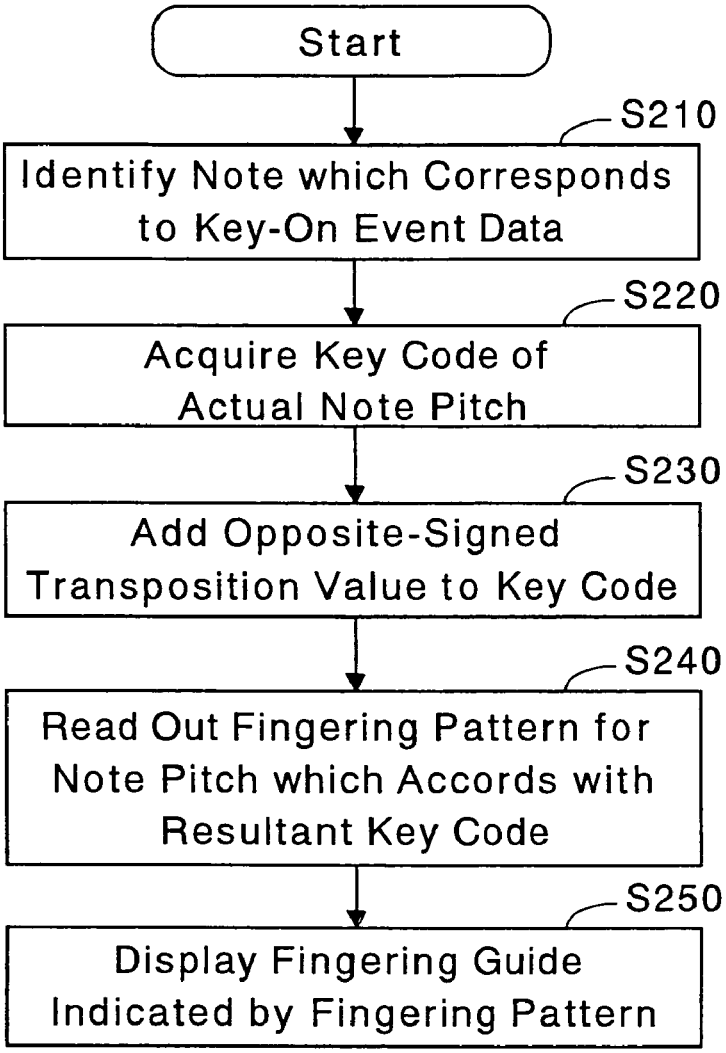

*Fig.8a* Transposed Music Score
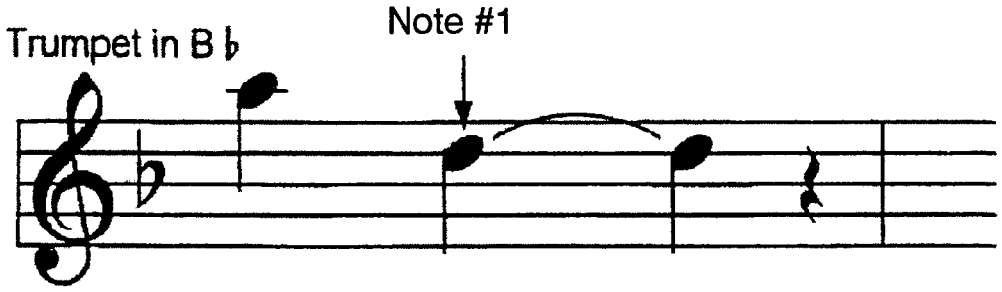
*Fig.8b* Transposed Music Score
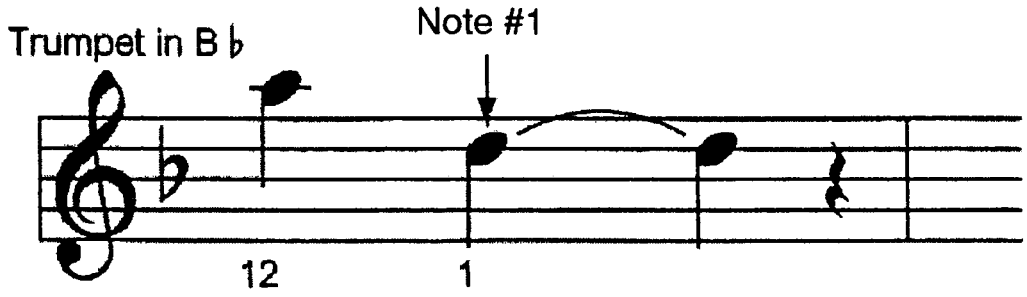

*Fig.9* Fingering Pattern Database

| Notated Pitch | Standard Fingering Pattern | Alternative Fingering Pattern | | |
|---|---|---|---|---|
| | | 1st Alternative | 2nd Alternative | 3rd Alternative |
| . . . | . . . | . . . | . . . | . . . |
| . . . | . . . | . . . | . . . | . . . |
| C5 | "0" | NULL | | |
| C#5 | "12" | NULL | | |
| D5 | "1" | "3" | NULL | |
| D#5 | "2" | "23" | NULL | |
| E5 | "0" | "12" | "3" | NULL |
| . . . | . . . | . . . | . . . | . . . |
| . . . | . . . | . . . | . . . | . . . |
| . . . | . . . | . . . | . . . | . . . |
| . . . | . . . | . . . | . . . | . . . |

*Fig. 10* Fingering Graphic Display Processing
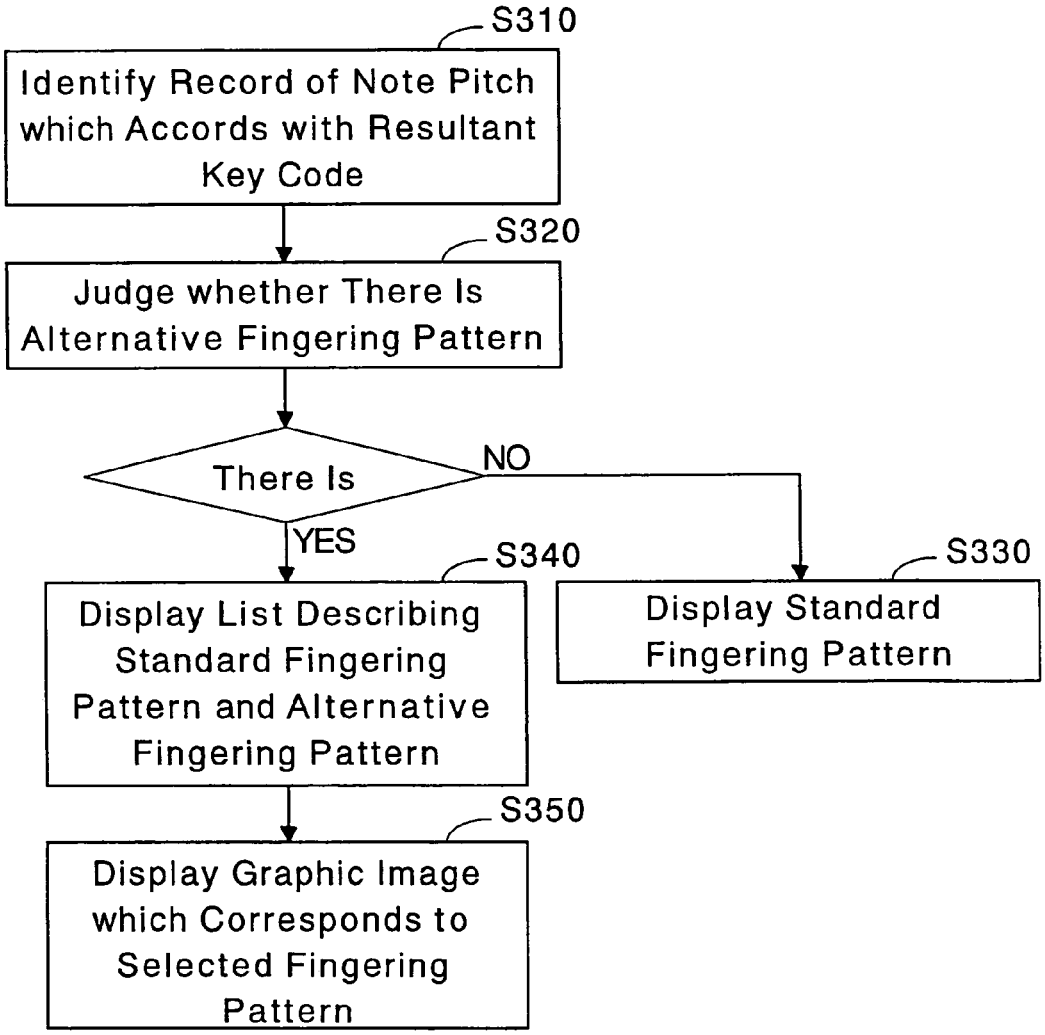

*Fig.11* Trill Fingering Database

| Notated Pitch | Trill Fingering | | | |
|---|---|---|---|---|
| | Interval 1 | | Interval 2 | |
| | Standard Fingering Pattern | Alternative Fingering Pattern | Standard Fingering Pattern | Alternative Fingering Pattern |
| . . . | . . . | . . . | . . . | . . . |
| . . . | . . . | . . . | . . . | . . . |
| . . . | . . . | . . . | . . . | . . . |
| . . . | . . . | . . . | . . . | . . . |
| . . . | . . . | . . . | . . . | . . . |
| . . . | . . . | . . . | . . . | . . . |
| . . . | . . . | . . . | . . . | . . . |
| . . . | . . . | . . . | . . . | . . . |
| . . . | . . . | . . . | . . . | . . . |
| . . . | . . . | . . . | . . . | . . . |

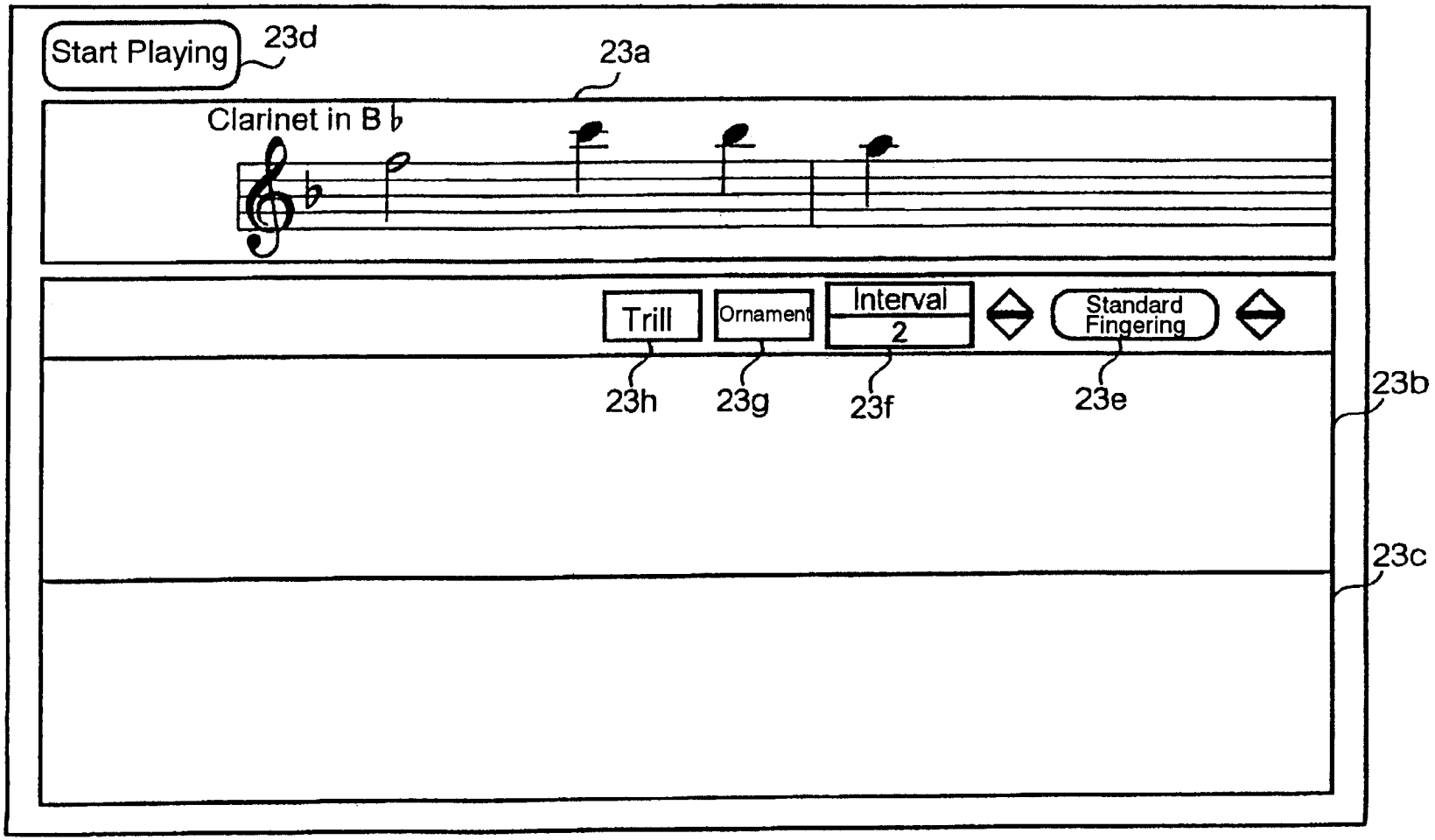
*Fig. 12* Fingering Graphic

*Fig. 13* Fingering Graphic Processing during Playback
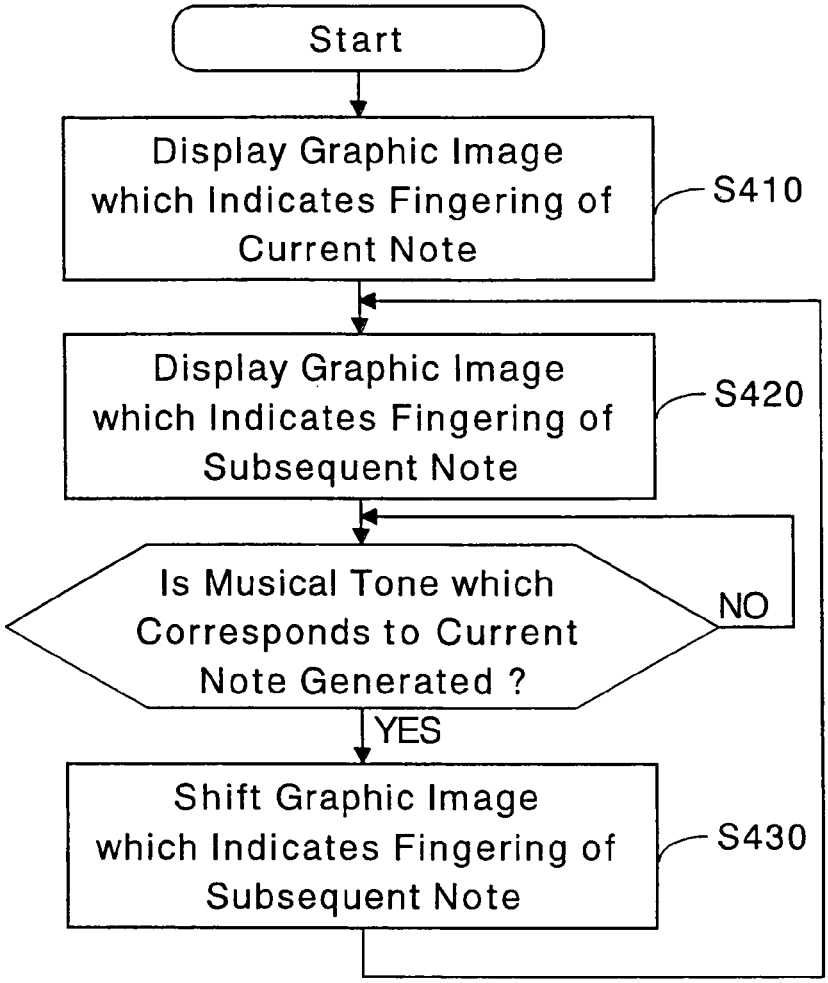

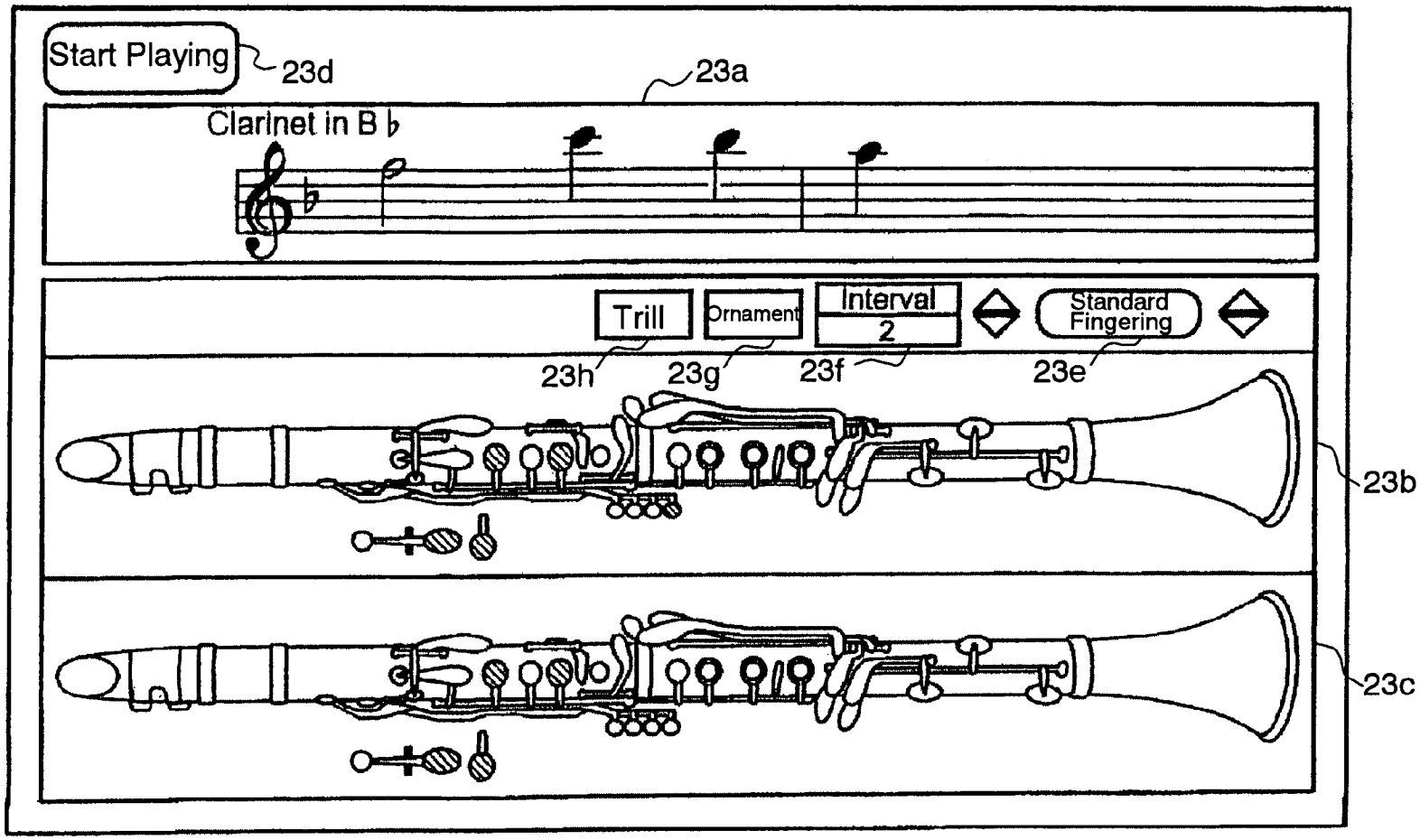
*Fig. 14* Fingering Graphic

*Fig. 15a* Fingering Graphic Processing during Play-Stop (Part 1)
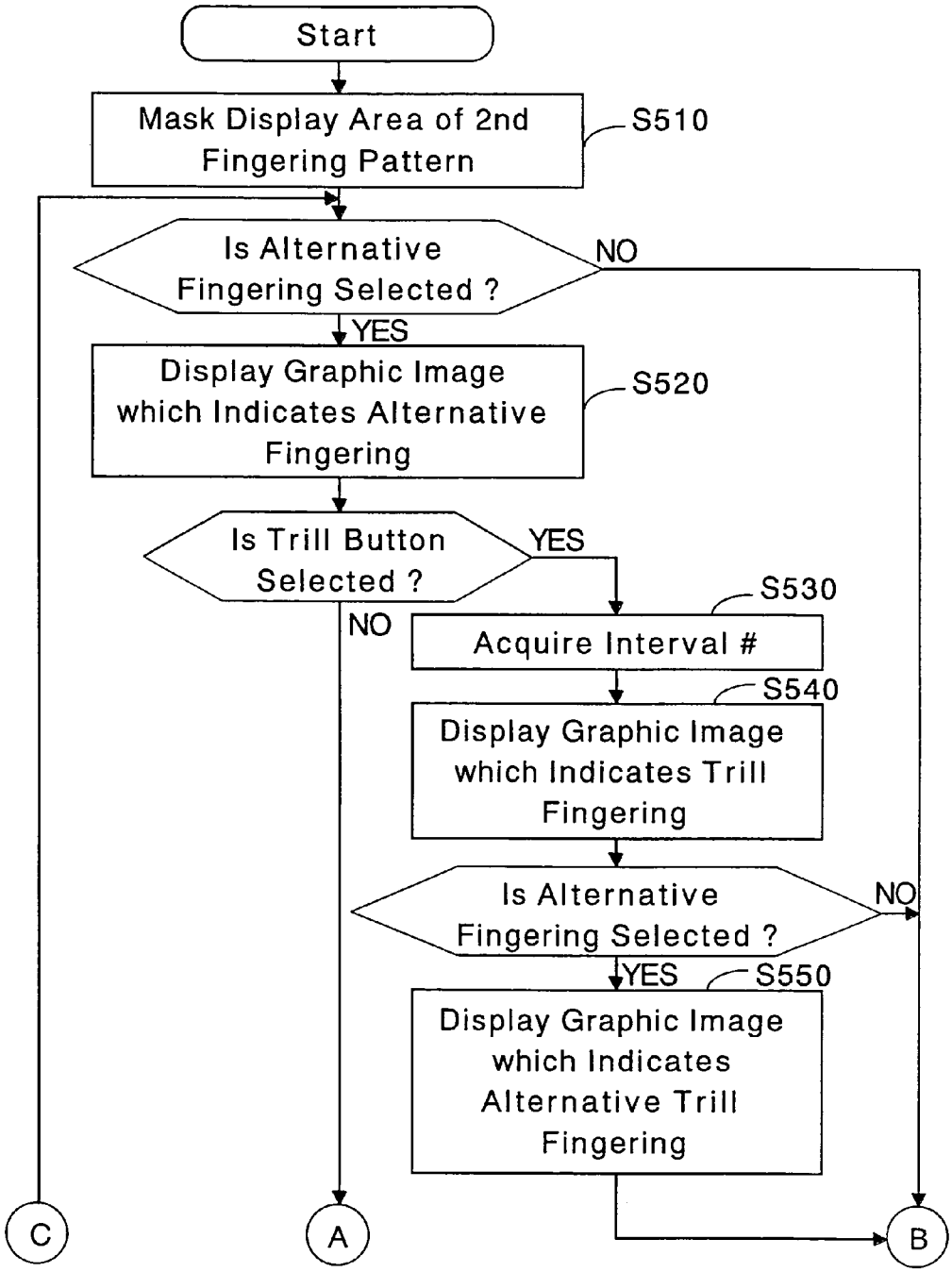

*Fig. 15b* Fingering Graphic Processing during Play-Stop (Part 2)
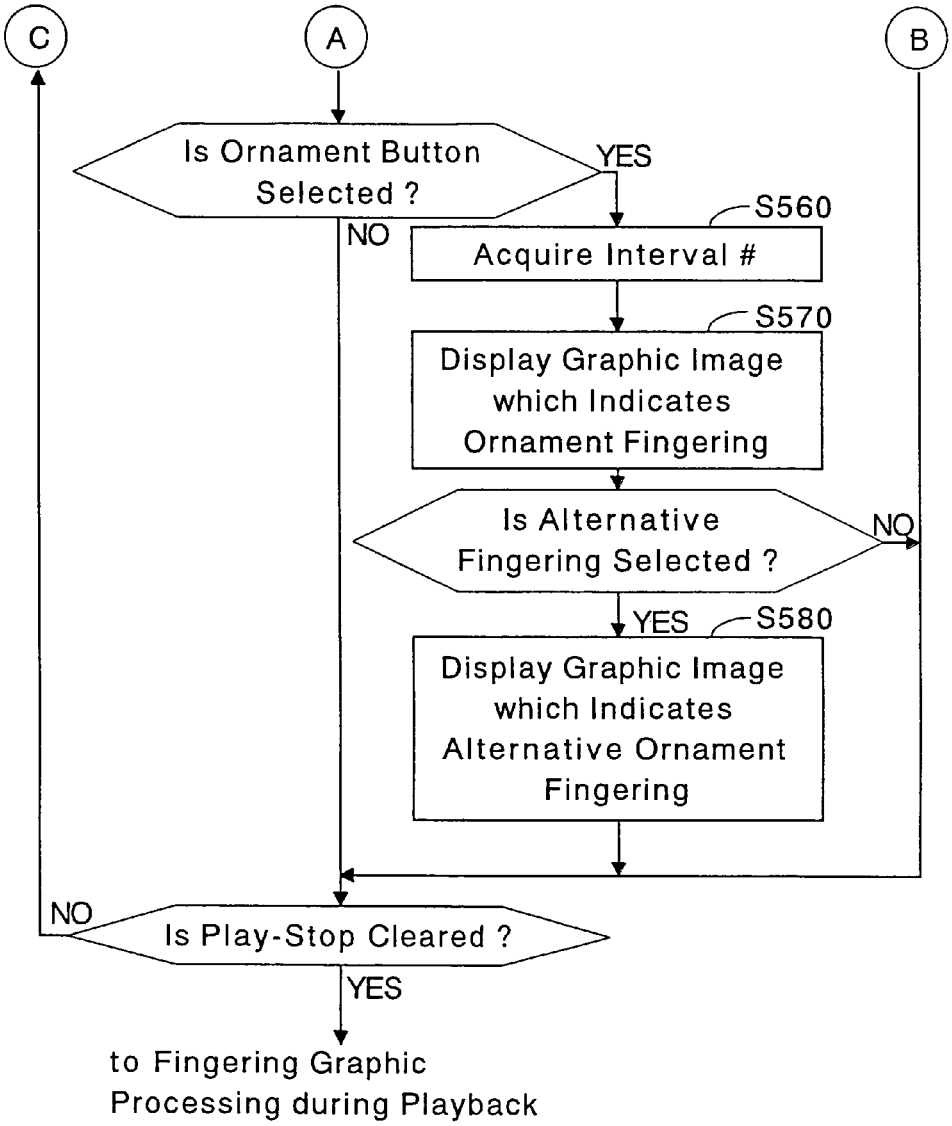

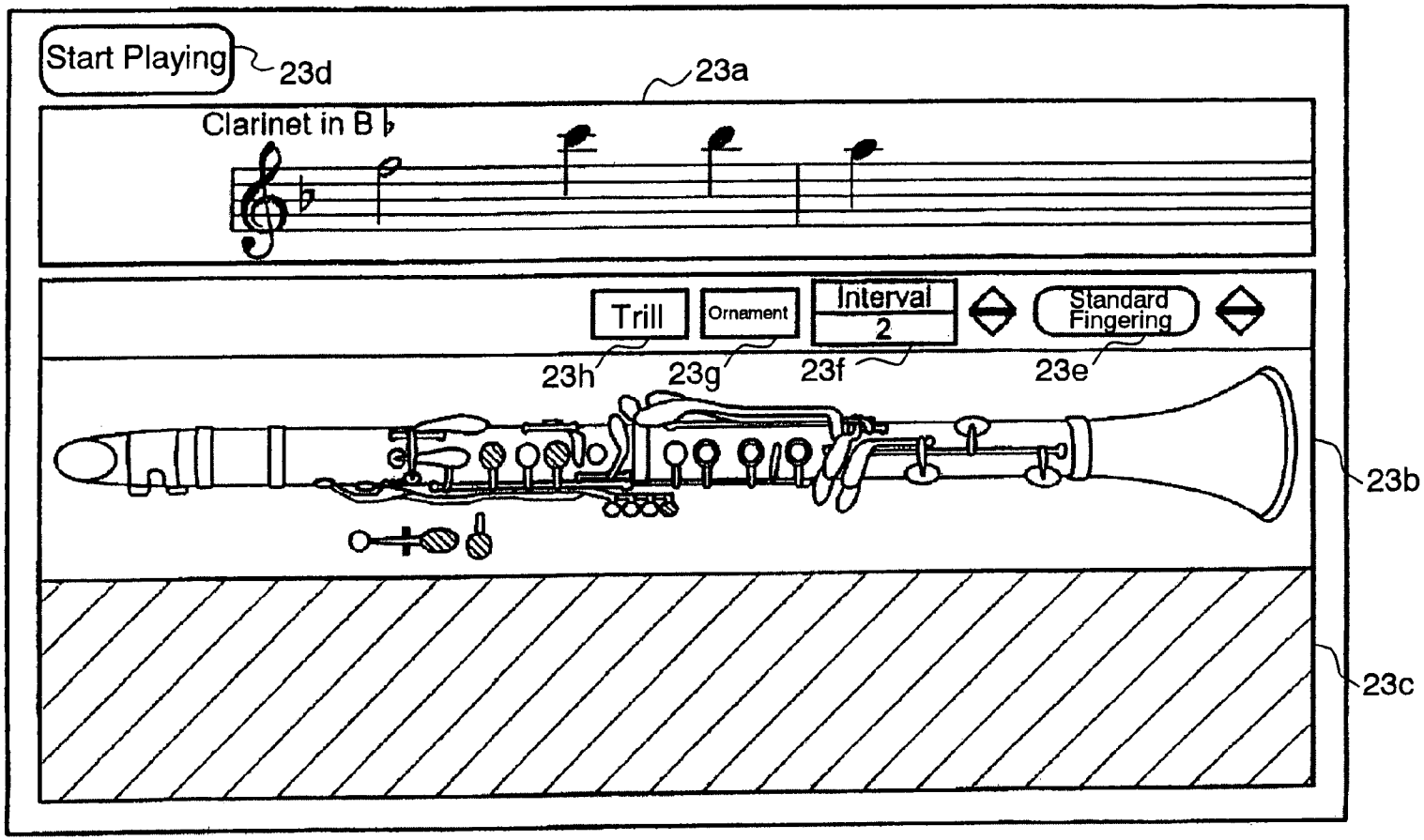
*Fig. 16* Fingering Graphic as Partly Masked

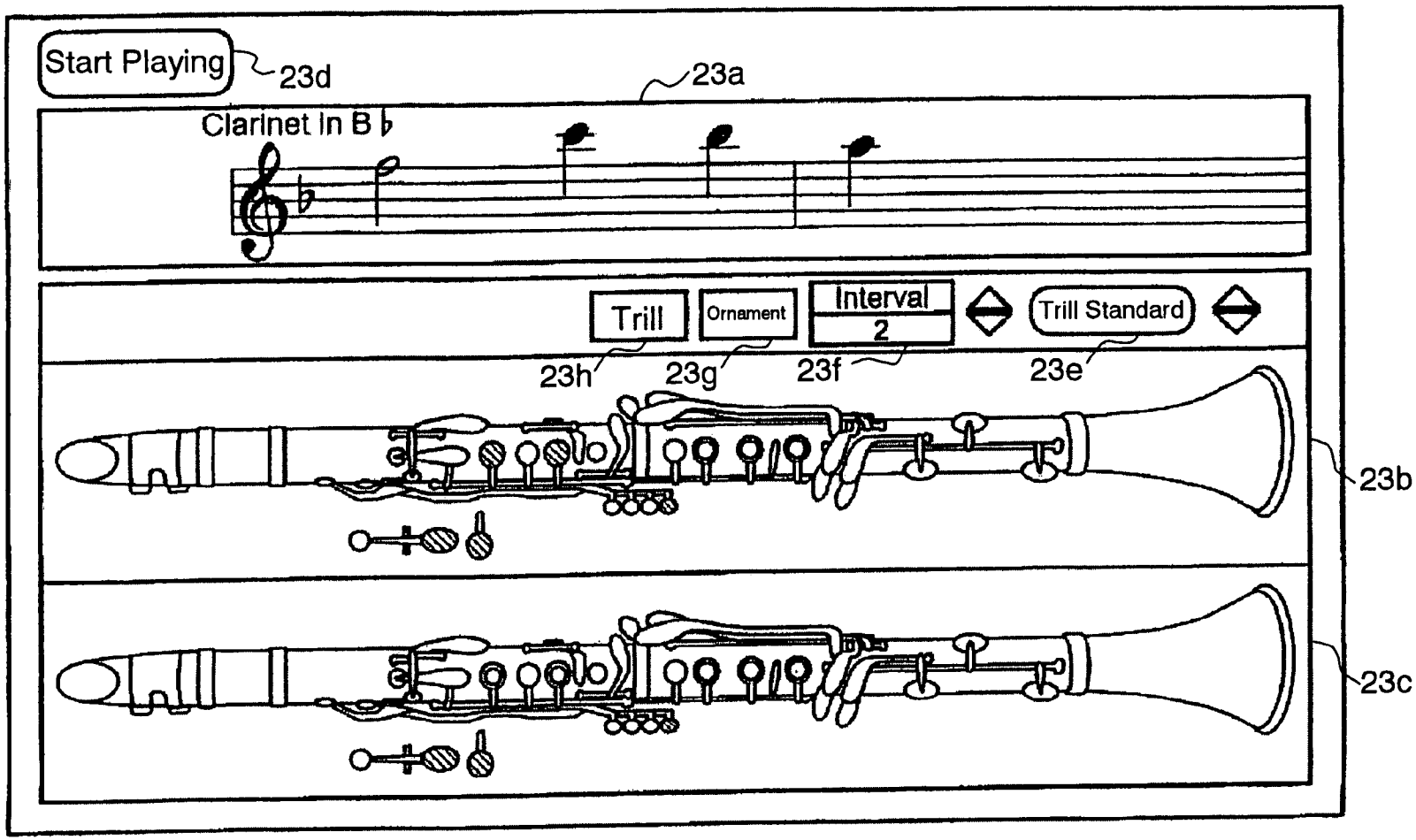
*Fig.17* Fingering Graphic for Trill

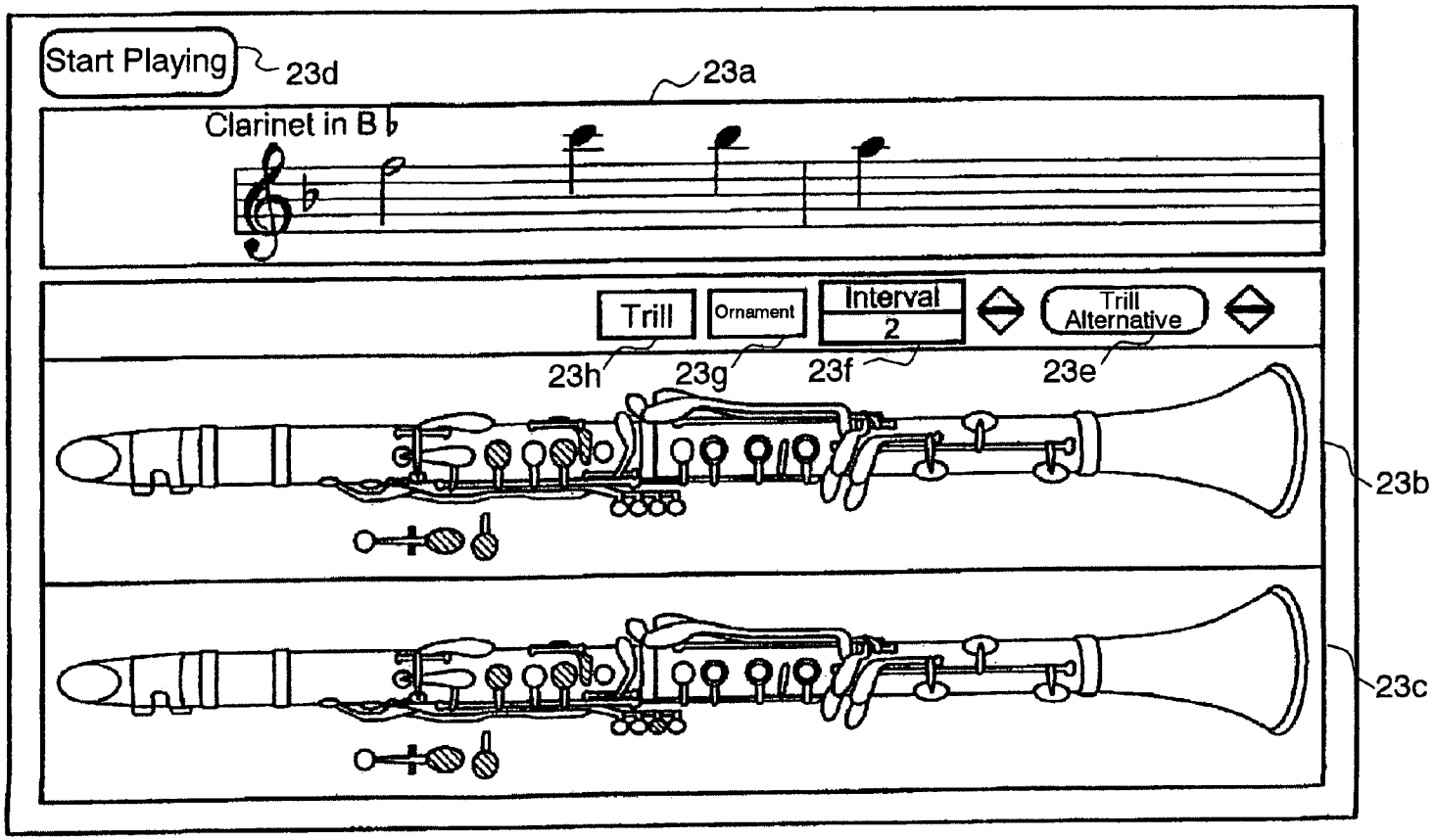
*Fig. 18* Fingering Graphic for Trill in Alternative

*Fig.*19 Physical Information

| Notated Pitch | Fingering Pattern (000) | Fingering Pattern (010) | Fingering Pattern (100) | Fingering Pattern (110) | Fingering Pattern (001) | Fingering Pattern (011) | Fingering Pattern (101) | Fingering Pattern (111) |
|---|---|---|---|---|---|---|---|---|
| B2 | | | | | | | | 2 L1+L2+L3 ◎ |
| C3 | | | | | | | 2 L1+ L3 ◎ | |
| C#3 | | | | | | 2 L2+L3 ◎ | | |
| D3 | | | | 2 L1+L2 ◎ | 2 L3 ○ | | | |
| E♭3 | | | 2 L1 ◎ | | | | | |
| E3 | | 2 L2 ◎ | | | | | | |
| F3 | 2 0 ◎ | | | | | | | |
| · · · | | | | | | | | |
| · · · | | | | | | | | |
| · · · | | | | | | | | |
| · · · | | | | | | | | |
| G4 | | | 5 L1 ◎ | | | | 6 L1+L3 ○ | |
| A♭4 | | 5 L2 ○ | | | | 6 L2+L3 ◎ | | |
| A4 | 5 0 ○ | | | 6 L1+L2 ◎ | 6 L3 ○ | | | 7 L1+L2+L3 ○ |
| B♭4 | | | 6 L1 ◎ | | | | 7 L1+L3 ○ | |
| B4 | | 6 L2 ◎ | | | | 7 L2+L3 ○ | | 8 L1+L2+L3 ○ |
| C5 | 6 0 ◎ | | | 7 L1+L2 ○ | 7 L3 ○ | | 8 L1+L3 ○ | |
| C#5 | | | 7 L1 ○ | | | 8 L2+L3 ◎ | | 9 L1+L2+L3 ○ |
| D5 | | 7 L2 ○ | | 8 L1+L2 ◎ | 8 L3 ○ | | 9 L1+L3 ○ | |
| E♭5 | 7 0 ○ | | 8 L1 ◎ | | | 9 L2+L3 △ | | 10 L1+L2+L3 ○ |
| E5 | | 8 L2 ◎ | | 9 L1+L2 △ | 9 L3 ○ | | 10 L1+L3 ○ | |
| F5 | 8 0 ◎ | | 9 L1 △ | | | 10 L2+L3 ○ | | 11 L1+L2+L3 ○ |
| F#5 | | 9 L2 ◎ | | 10 L1+L2 ○ | 10 L3 ○ | | 11 L1+L3 ○ | 12 L1+L2+L3 ○ |
| G5 | 9 0 ◎ | | 10 L1 ○ | | | 11 L2+L3 ○ | 12 L1+L3 ○ | |
| A♭5 | | 10 L2 ○ | | 11 L1+L2 ○ | 11 L3 ○ | 12 L2+L3 ◎ | | 13 L1+L2+L3 ○ |
| A5 | 10 0 ○ | | 11 L1 ○ | 12 L1+L2 ◎ | 12 L3 ○ | | 13 L1+L3 ○ | 14 L1+L2+L3 ○ |
| B♭5 | | 11 L2 ○ | 12 L1 ◎ | | | 13 L2+L3 ○ | 14 L1+L3 ○ | 15 L1+L2+L3 ○ |
| B5 | 11 0 ○ | 12 L2 ◎ | | 13 L1+L2 ○ | 13 L3 ○ | 14 L2+L3 ○ | 15 L1+L3 ○ | 16 L1+L2+L3 ○ |
| C6 | 12 0 ◎ | | 13 L1 ○ | 14 L1+L2 ○ | 14 L3 ○ | 15 L2+L3 ○ | 16 L1+L3 ○ | |

*Fig. 20a* Fingering Display Processing (Part 1)
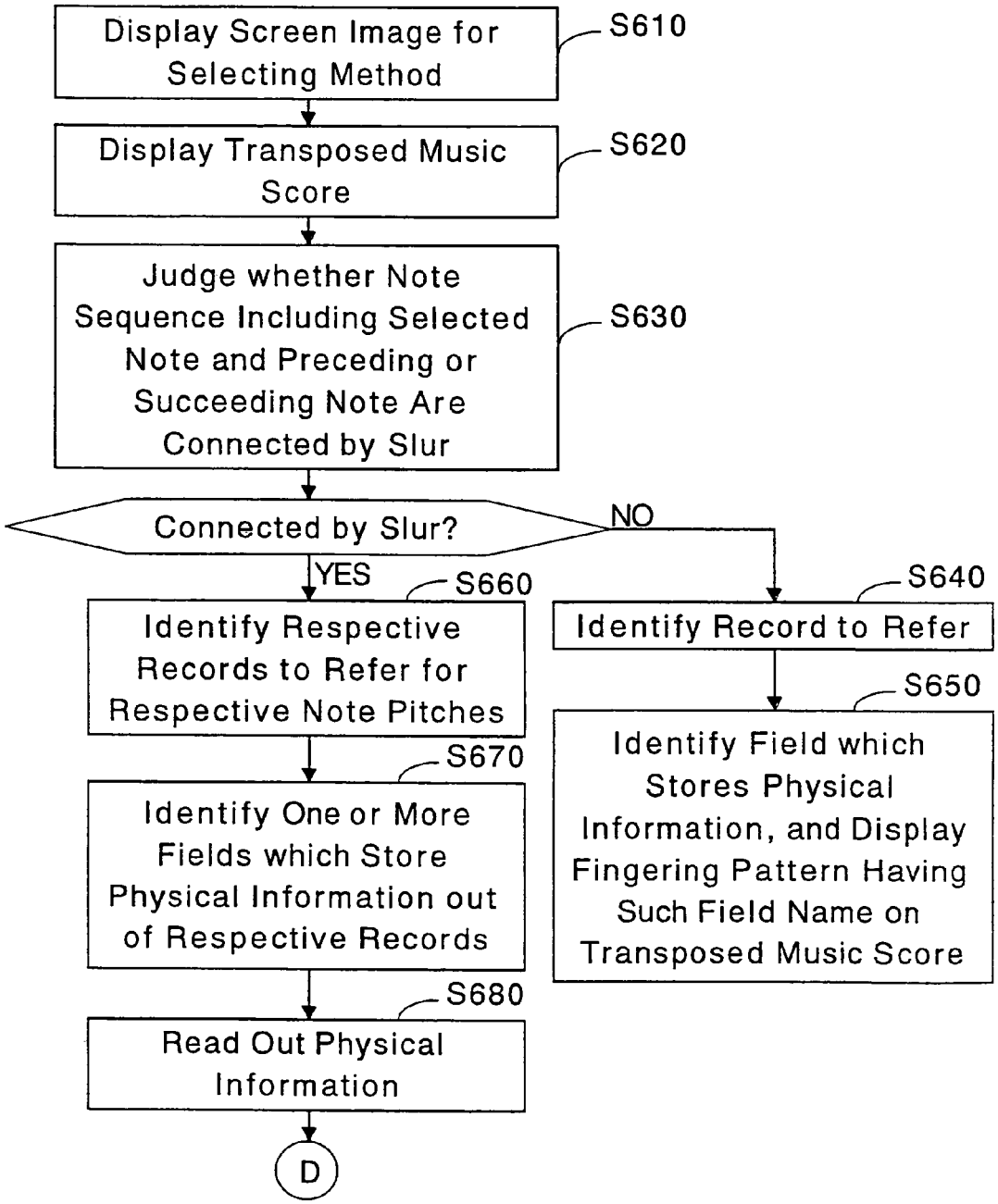

*Fig. 20b* Fingering Display Processing (Part 2)
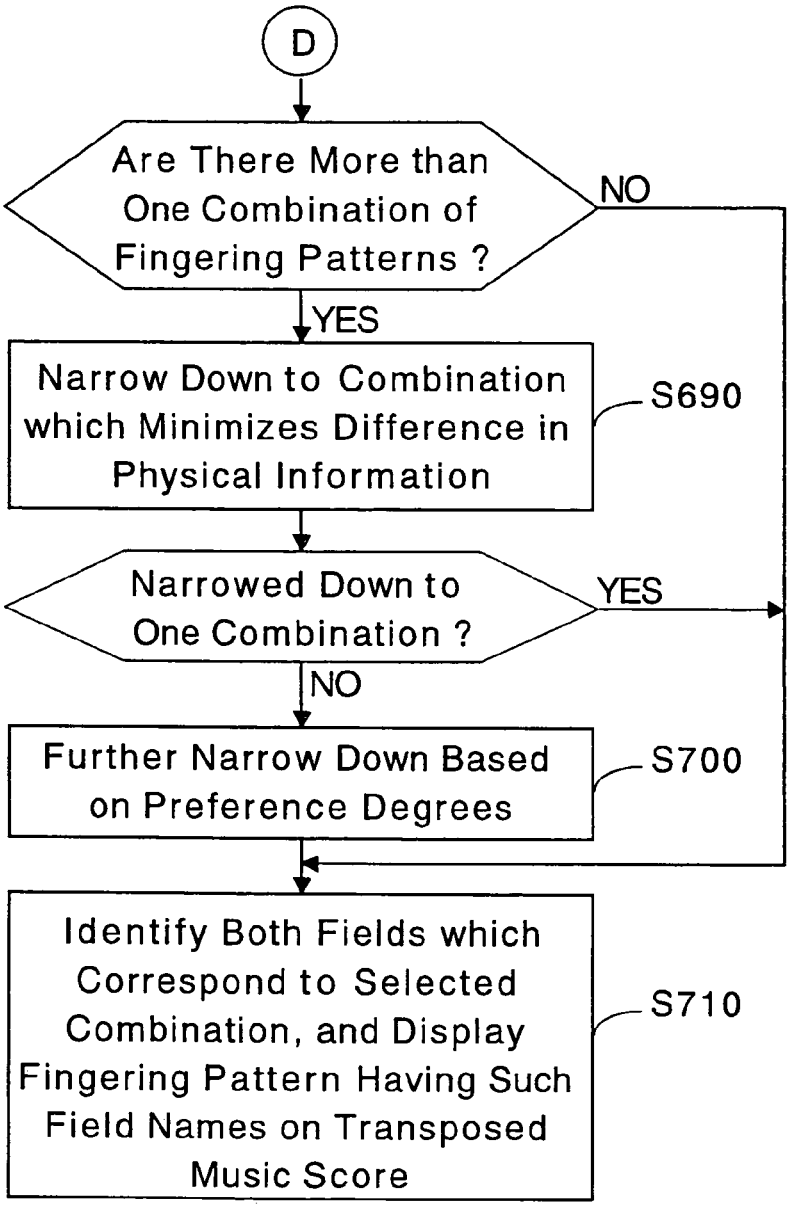

*Fig.21* Transposed Music Score
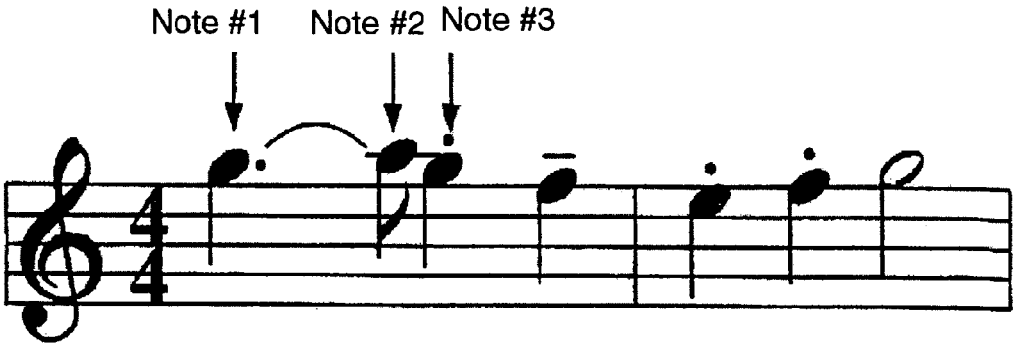

FINGERING GUIDE DISPLAYING APPARATUS FOR MUSICAL INSTRUMENT AND COMPUTER PROGRAM THEREFOR

TECHNICAL FIELD

The present invention relates to a fingering guide displaying apparatus for musical instrument, and computer program for realizing such an apparatus using a computer system, and more particularly to an apparatus for displaying fingering guide for wind musical instruments.

BACKGROUND INFORMATION

In order to play a musical instrument, one has first to learn and master the fingering system for such a musical instrument, where different kinds of musical instruments employ different fingering systems. There have been proposed various technologies to assist learners in mastering the fingering methods efficiently. For example, unexamined Japanese patent publication No. H01-314282 discloses a fingering guide displaying apparatus which aids a learner to master the fingering methods for the trill or tremolo playing in playing wood wind musical instruments. The apparatus according to this publication is to alternately display two fingering patterns respectively corresponding to two note pitches to be played in the trill or tremolo playing. Unexamined Japanese patent publication No. 2000-112470 discloses a fingering guide displaying apparatus which gives guidance of detailed fingering methods according to the progression of the music. The apparatus according to this publication is to display a series of images showing the transition of the fingering from the release from one key till the depression on another key successively along with the progression of the music. Unexamined Japanese patent publication No. 2000-3171 discloses a fingering data creating apparatus which stores in a small data amount the movements of fingers to be referred to in learning the fingering methods. The apparatus according to this publication provides a recording mode and a playback mode which are selectable by the user, in which the recording mode is to take pictures of the fingering movements of the instrument player using a so-called motion capture technique and to capture the movements of only the joints of the respective fingers as serial fingering data, whereas the playback mode is to display images from the serial data created in the form of polygons based on the respective fingering data along with the progression of the music.

In guiding the fingering methods for wind musical instruments, however, careful considerations should be given in handling the note pitches, as most of wind musical instruments such as trumpets, clarinets and horns are so-called transposing instruments and accordingly there are pitch differences between the notes in the musical scores notated for such wind musical instruments and the actual notes which are usually notated in the key (tonality) of C. For example, there are two kinds of clarinets which are transposing instruments, one in the Bb tonality on which the notes sound a major second (two semitones) lower than the notes notated on the music score for the instrument, and the other in the A tonality on which the notes sound a minor third (three semitones) lower than the notes notated on the music score for the instrument. Accordingly, if a player plays a music piece reading a music score written in the key of C, the actual note pitches produced will be a major 2nd below the notes notated on the score in the case of the Bb clarinet, while the actual note pitches produced will be a minor 3rd below the notes notated on the score in the case of the A clarinet. It should be understood herein that the musical flat sign will be represented by an alphabet character "b" where necessary for the convenience of typewriting. With the conventional fingering guide apparatuses heretofore proposed, however, the music playing data have been prepared with the note data defining notes in one tonality (in most of cases, in the key of C) only, and the apparatus can only indicate the fingering patterns for the defined note pitches to the learner, which has been a kind of inconvenient in learning the fingering methods of the transposing musical instrument.

In many wind musical instruments, there are several fingering patterns or methods available to produce the same note pitch with respect to some of the available notes on the instrument. Among several fingering patterns to produce a same note pitch, some fingering patterns are very difficult to handle and are for particular use by advanced learners, while some are not so difficult to handle and can be used by beginners. However, heretofore proposed fingering guide display device would simply enumerate plural fingering patterns for a single note pitch, even if there are plural fingering patterns available to play the same note pitch, and could not indicate preferable ones selected according to the skill level of the learner.

SUMMARY OF THE INVENTION

It is, therefore, a primary object of the present invention to solve the above described drawbacks with the conventional fingering guide displaying apparatuses and to provide a novel type of fingering guide displaying apparatus and a computer program for realizing such an apparatus using a computer system, in which the fingering guide displaying apparatus can display preferable fingering guides with the characters of the respective instruments and the levels of the learners taken into consideration.

According to the present invention, the object is accomplished by providing a fingering guide displaying apparatus comprising: a display device; a storage device for storing music piece constituting note data which represent a group of notes to constitute a music piece as expressed according to a nomenclature in a reference tonality, transposition data which represent for at least one transposing musical instrument a pitch difference between the reference tonality and an instrument tonality which is unique to the transposing musical instrument, and fingering pattern data which represent fingering patterns for available notes of the transposing musical instrument as expressed in a nomenclature in the instrument tonality; a play note identifying device for identifying notes to be played at respectively given times out of the group of notes represented by the music piece constituting note data; a note pitch shifting device for reading out the transposition data from the storage device, and respectively transposing the pitches of the identified notes by the amount of the pitch difference represented by the transposition data to obtain respectively shifted note pitches which are expressed in the nomenclature in the instrument tonality and which are respectively identical with the pitches of the respectively identified notes as expressed in the reference tonality; and a display control device for reading out from the storage device the fingering pattern data representing fingering patterns which respectively correspond to the shifted note pitches obtained by the note pitch shifting device, and causing the display device to display the fingering patterns represented by the read-out fingering pattern data.

In an aspect of the present invention, the display control device may cause the display device to display each of the fingering patterns in the form of a character string indicating the fingering pattern, or in the form of a picture image showing the transposing musical instrument as fingered in the fingering pattern, or in both of such forms.

In another aspect of the present invention, the storage device may store the fingering pattern data to represent one or more fingering patterns for each available note of the transposing musical instrument, and the display control device may judge whether a plurality of fingering patterns are provided for one shifted note pitch of the identified note based on the fingering pattern data stored in the storage device, and, if a plurality of fingering patterns are provided for one shifted note pitch, may cause the display device to display the plurality of fingering patterns represented by the fingering pattern data for that one shifted note pitch.

In a still other aspect of the present invention, if a plurality of fingering patterns are provided for one shifted note pitch, the display control device may prioritize the plurality of fingering patterns for that one shifted note pitch according to a predetermined criterion and may cause the display device to display the plurality of fingering patterns with the priority levels.

In a still further aspect of the present invention, if a plurality of fingering patterns are provided for one shifted note pitch, the display control device may select one of the fingering patterns for that one shifted note pitch according to a predetermined criterion of selection and may cause the display device to display thus selected fingering pattern for that one shifted note pitch.

In a still further aspect of the present invention, the fingering guide displaying apparatus may further comprise an input device for inputting an instrument tonality of a transposing musical instrument, and the storage device may store transposition data which represent for each of a plurality of instrument tonalities a pitch difference between the reference tonality and each instrument tonality, and the note pitch shifting device may read out from the storage device the transposition data which represent the pitch difference with respect to the instrument tonality inputted from the input device.

In a still further aspect of the present invention, the fingering guide displaying apparatus may further comprise a subsequent play note identifying device for identifying a subsequent note to be played subsequent to the note to be played at each given time out of the group of notes represented by the music piece constituting note data, and the display control device may read out from the storage device the fingering pattern data representing a fingering pattern which corresponds to the shifted note pitch obtained from the subsequent note by means of the note pitch shifting device, and may cause the display device to display the fingering pattern corresponding to the shifted note pitch obtained from the subsequent note together with the fingering pattern corresponding to the shifted note pitch of the note at the given time.

In a still further aspect of the present invention, the fingering guide displaying apparatus may further comprise a display time notifying device for notifying fingering pattern display times to display respective fingering patterns for the respective notes constituting the music piece, each of the fingering pattern display times being a time which precedes the time when each corresponding note is to be played by a predetermined amount of time, and the display control device may cause the display device to display the fingering pattern for each corresponding note when each fingering pattern display time is notified.

In a still further aspect of the present invention, the fingering guide displaying apparatus may further comprise a tone signal generating device for generating musical tones successively according to the play progression of the music piece based on the music piece constituting data, and a play stop detecting device for detecting a stoppage of the play progression of the music piece, and the display control device may cause the display device to display the fingering pattern during the time at which the stoppage of the play progression of the music piece is being detected.

According to the present invention, the object is further accomplished by providing a fingering guide displaying apparatus comprising: a display device; a storage device for storing music piece constituting note data which represent a group of notes to constitute a music piece as expressed according to a nomenclature in a reference tonality, notational sign data which represent notational signs each indicating a playing manner of consecutive notes to be played as connected notes in the group of notes, and fingering pattern data which represent sets of standard fingering patterns and alternative fingering patterns, a set of a standard fingering pattern and at least one alternative fingering pattern being provided for each of available note pitches of a given musical instrument; a play note identifying device for identifying notes to be played at respectively given times out of the group of notes represented by the music piece constituting note data, consecutive notes before and after the note at each the given time being identified in a set; a connective note judging device for judging whether there is a notational sign connecting the note to be played at the given time with the preceding note or whether there is a notational sign connecting the note to be played at the given time with the succeeding note based on the notational sign data stored in the storage device; a display control device for reading out from the storage device the fingering pattern data of the standard fingering pattern for the note to be played at the given time, if the connective note judging device judges there is not a notational sign connecting the consecutive notes at the given time, and for reading out the fingering pattern data of the alternative fingering pattern for the note to be played at the given time, if the connective note judging device judges there is a notational sign connecting the consecutive notes before and/or after the note at the given time, and causing the display device to display the fingering patterns represented by the read-out fingering pattern data.

In a still further aspect of the present invention, the storage device may store the fingering pattern data which represent a set of one standard fingering pattern and at least one alternative fingering pattern for each of available note pitches of the given musical instrument; and if the connective note judging device judges there is such a notational sign, the display control device may judge whether there are a plurality of alternative fingering patterns provided for the note to be played at the given time based on the fingering pattern data stored in the storage device, and if a plurality of alternative fingering patterns are provided for the note, may prioritize the plurality of alternative fingering patterns according to a predetermined criterion and may cause the display device to display the plurality of fingering patterns with the priority levels.

In a still further aspect of the present invention, the storage device may store the fingering pattern data which represent a set of one standard fingering pattern and at least one alternative fingering pattern for each of available note pitches of the given musical instrument; and if the connective note judging device judges there is such a notational sign, the display control device may judge whether there are a plurality of alternative fingering patterns provided for the note to be played at the given time based on the fingering pattern data stored in the storage device, and if a plurality of alternative fingering patterns are provided for the note, may select one of the alternative fingering patterns according to a predetermined criterion of selection and may cause the display device to display thus selected fingering pattern.

According to the present invention, the object is still further accomplished by providing a fingering guide displaying apparatus comprising: a display device; a storage device for storing music piece constituting note data which represent a group of notes to constitute a music piece as expressed according to a nomenclature in a reference tonality, fingering pattern data which represent a set of one or more fingering patterns to play each of available note pitches of a given musical instrument, and physical condition data which quantitatively represent physical conditions of a given musical instrument when said musical instrument is played according to the fingering patterns indicated by said fingering pattern data, the physical conditions being provided in correspondence to the fingering patterns; a play note identifying device for identifying a note to be played at a given time and its subsequent note out of the group of notes represented by the music piece constituting note data; a play note fingering pattern identifying device for identifying one or more fingering patterns represented by the fingering pattern data stored in the storage device corresponding to the note to be played at the given time; a subsequent note fingering pattern identifying device for identifying one or more fingering patterns represented by the fingering pattern data stored in the storage device corresponding to the subsequent note to be played subsequent to the given time; a fingering pattern set determining device for determining a fingering pattern set by selecting a play note fingering pattern from among the fingering patterns as identified corresponding to the note to be played at the given time and a subsequent note fingering pattern from among the fingering patterns as identified corresponding to the subsequent note so that the difference between the physical condition at the selected play note fingering pattern and the physical condition at the selected subsequent note fingering pattern be minimal among other possible selections based on the physical condition data stored in the storage device; and a display control device for reading out from the storage device the fingering pattern data representing the determined set of the play note fingering pattern and the subsequent note fingering pattern, and causing the display device to display the determined set of fingering patterns successively along with the play progression of the music piece.

In a still further aspect of the present invention, the music piece constituting note data may represent a progression of a music piece in terms of a sequence of event data pieces of the constituting notes as expressed according to a nomenclature in a reference tonality, which may be the key of C.

According to the present invention, the object is still further accomplished by providing a computer readable medium containing executable instructions for causing a processor to perform a method for displaying a fingering guide for playing a musical instrument on an apparatus having a display device, and a storage device for storing music piece constituting note data which represent a group of notes to constitute a music piece as expressed according to a nomenclature in a reference tonality, transposition data which represent for at least one transposing musical instrument a pitch difference between the reference tonality and an instrument tonality which is unique to the transposing musical instrument, and fingering pattern data which represent fingering patterns for available notes of the transposing musical instrument as expressed in a nomenclature in the instrument tonality, the method comprising the steps of: identifying notes to be played at respectively given times out of the group of notes represented by the music piece constituting note data; reading out the transposition data from the storage device; respectively transposing the pitches of the identified notes by the amount of the pitch difference represented by the transposition data to obtain respectively shifted note pitches which are expressed in the nomenclature in the instrument tonality and which are respectively identical with the pitches of the respectively identified notes as expressed in the reference tonality; reading out from the storage device the fingering pattern data representing fingering patterns which respectively correspond to the shifted note pitches obtained by the transposing step; and causing the display device to display the fingering patterns represented by the read-out fingering pattern data.

According to the present invention, the object is still further accomplished by providing a computer readable medium containing executable instructions for causing a processor to perform a method for displaying a fingering guide for playing a musical instrument on an apparatus having a display device, and a storage device for storing music piece constituting note data which represent a group of notes to constitute a music piece as expressed according to a nomenclature in a reference tonality, notational sign data which represent notational signs each indicating a playing manner of consecutive notes to be played as connected notes in the group of notes, and fingering pattern data which represent sets of standard fingering patterns and alternative fingering patterns, a set of a standard fingering pattern and at least one alternative fingering pattern being provided for each of available note pitches of a given musical instrument, the method comprising the steps of: identifying notes to be played at respectively given times out of the group of notes represented by the music piece constituting note data, consecutive notes before and after the note at each the given time being identified in a set; judging whether there is a notational sign connecting the note to be played at the given time with the preceding note or whether there is a notational sign connecting the note to be played at the given time with the succeeding note based on the notational sign data stored in the storage device; reading out from the storage device the fingering pattern data of the standard fingering pattern for the note to be played at the given time, if the judging step judges there is not a notational sign connecting the consecutive notes at the given time, and for reading out the fingering pattern data of the alternative fingering pattern for the note to be played at the given time, if the judging step judges there is a notational sign connecting the consecutive notes before and/or after the note at the given time; and causing the display device to display the fingering patterns represented by the read-out fingering pattern data.

According to the present invention, the object is still further accomplished by providing a computer readable medium containing executable instructions for causing a processor to perform a method for displaying a fingering guide for playing a musical instrument on an apparatus having a display device, and a storage device for storing music piece constituting note data which represent a group of notes to constitute a music piece as expressed according to a nomenclature in a reference tonality, fingering pattern data which represent a set of one or more fingering patterns to play each of available note pitches of a given musical instrument, and physical condition data which quantitatively represent physical conditions of a given musical instrument when the musical instrument is played according to the fingering patterns indicated by the fingering pattern data, the physical conditions being provided in correspondence to the fingering patterns, the method comprising the steps of: identifying a note to be played at a given time and its subsequent note out of the group of notes represented by the music piece constituting note data; identifying one or more fingering patterns represented by the fingering pattern data stored in the storage device corresponding to the note to be played at the given time; identifying one or more fingering patterns represented by the fingering pattern data stored in the storage device corresponding to the subsequent note to be played subsequent to the given time; determining a fingering pattern set by selecting a play note fingering pattern from among the fingering patterns as identified corresponding to the note to be played at the given time and a subsequent note fingering pattern from among the fingering patterns as identified corresponding to the subsequent note so that the difference between the physical condition at the selected play note fingering pattern and the physical condition at the selected subsequent note fingering pattern be minimal among other possible selections based on the physical condition data stored in the storage device; reading out from the storage device the fingering pattern data representing the determined set of the play note fingering pattern and the subsequent note fingering pattern; and causing the display device to display the determined set of fingering patterns successively along with the play progression of the music piece.

According to the present invention, the fingering guide displaying apparatus can display preferable fingering guides for the learners, wherein the characters of the respective instruments and the levels of the learners are well taken into consideration.

As will be apparent from the description herein later, some of the structural element devices of the present invention are configured by a computer system performing the assigned functions according to the associated programs. They may of course be hardware structured discrete devices. Therefore, a hardware-structured device performing an intended function and a computer-configured arrangement performing the same function should be considered a same-named device or an equivalent to each other.

BRIEF DESCRIPTION OF THE DRAWINGS

For a better understanding of the present invention, and to show how the same may be practiced and will work, reference will now be made, by way of example, to the accompanying drawings, in which:

FIG. 1 is a block diagram illustrating the hardware configuration of an embodiment of the present invention;

FIG. 2 is a table illustrating the data structure of a transposition value database;

FIG. 3 is a table illustrating the data structure of a fingering pattern database;

FIGS. 4*a* and 4*b* are perspective view of a trumpet at rest and as fingered, respectively;

FIG. 5 is a chart illustrating the data structure of music piece information;

FIG. 6 is a flow chart describing an example of music score display processing according to the present invention;

FIG. 7 is a flow chart describing an example of fingering display processing according to the present invention;

FIG. 8*a* is a chart illustrating a transposed music score;

FIG. 8*b* is a chart illustrating a transposed music score with fingering indications;

FIG. 9 is a table illustrating the data structure of a fingering pattern database;

FIG. 10 is a flow chart describing an example of fingering graphic display processing;

FIG. 11 is a table illustrating the data structure of a trill fingering database;

FIG. 12 is a chart illustrating a screen image of a graphic fingering guide;

FIG. 13 is a flow chart describing an example of fingering graphic display processing during the playback of a music piece;

FIG. 14 is a chart illustrating a screen image of a graphic fingering guide;

FIGS. 15*a* and 15*b* are, in combination, a flow chart describing an example of fingering graphic display processing during the play-stop of a music piece;

FIG. 16 is a chart illustrating a screen image of a graphic fingering guide as partly masked;

FIG. 17 is a chart illustrating a screen image of a graphic fingering guide for a trill performance;

FIG. 18 is a chart illustrating a screen image of a graphic fingering guide for a trill performance in an alternative way;

FIG. 19 is a table illustrating the data structure of physical information;

FIGS. 20*a* and 20*b* are, in combination, a flow chart describing fingering display processing; and FIG. 21 is a chart illustrating a transposed music score.

DESCRIPTION OF THE PREFERRED EMBODIMENTS

Herein below will be described embodiments of the present invention with reference to the accompanying drawings.

Embodiment 1

A first embodiment of the fingering guide display apparatus according to the present invention is characterized in that it displays music scores of transposing musical instruments individually with respect to different instrument tonalities according to the wind musical instruments with indications of proper fingering patterns (fingering methods) taking transpositions into consideration successively along with the progression of the music piece for those who learn how to finger the wind musical instruments (hereinafter, "learners"). In the following description, the term "a reference tonality" means the tonality (or key) of C on which the notes are defined by the note names having the actual note pitches, and "an instrument tonality" means the tonality (or key) unique to a transposing musical instrument which sounds a note pitch of the same name as the instrument tonality when it is played (executed) with the fingering pattern for the note C as notated on the music score for the instrument.

FIG. 1 shows a block diagram illustrating the hardware configuration of a fingering guide displaying apparatus as the first embodiment of the present invention. This embodiment is configured by using a computer and is operated or controlled by a micro computer comprising a microprocessor unit or central processing unit (CPU) 11, a read-only memory (ROM) 12 and a random access memory (RAM) 13.

The CPU 11 controls the overall operations of the apparatus. To the CPU 11 are connected the ROM 12, the RAM 13, a MIDI interface 14, a control circuit 15, a display circuit 16, a tone generator circuit 17, an external storage device 18 and a communication interface 19 via a data bus 10. Further connected to the CPU 11 is a timer 20 which counts interruption times for the timer interrupt processing and various other times. The timer 20 also counts time intervals and generates clock pulses for setting the tempo to play back a music piece. The ROM 12 stores various control programs to be executed by the CPU 11 and image data of staves, notes, rests, and other notational signs and symbols for creating transposed music scores from the music piece data (as will be described later). The ROM further stores a transposition value database, and a plurality of fingering pattern databases prepared individually for the respective instrument tonalities.

FIG. 2 shows a table illustrating the data structure of a transposition value database, which is a collection of plural records each corresponding to each of wind musical instruments. One of the records constituting this database has three fields, namely, "musical instrument name," "instrument tonality" and "transposition value." In the field of "musical instrument name" are stored the names of various wind musical instruments such as a trumpet, a clarinet and so forth. In the field of "instrument tonality" are stored the tonalities of the respective instruments. For example, a trumpet and a clarinet are both instruments in the same tonality of Bb (B flat). In the field of "transposition value" are stored numerical values each indicating the pitch difference of the instrument tonality which is unique to each musical instrument from the reference tonality (the key of C) in terms of the number of semitones. For example, the top record of the table in FIG. 2 includes the transposition value of "−2" (minus 2) for the instrument of "trumpet" and this means that the trumpet in Bb produces tones of the pitches which are respectively lower than the actual pitches by two semitones for the respective notated note pitches. In other words, in order to produce a tone having the actual pitch of C, the player has to play the trumpet using the fingering pattern for the notated note D.

FIG. 3 shows a table illustrating the data structure of a fingering pattern database prepared for the trumpet (in the key of Bb). The fingering pattern databases are prepared for the respective wind musical instruments on a per instrument basis, wherein every database has the same field arrangement of each record. Each record in the database has two fields, i.e. "the notated pitch" and the "fingering pattern." In the field of "notated pitch" are stored the pitches of the respective notes to be notated on the music score for the wind musical instrument. In the field of "fingering pattern" are stored the fingering patterns for the respective notated pitches. Each of the fingering patterns is a character string indicating the combination of the valves to be depressed by fingers to produce a tone of the corresponding note pitch. The trumpet has three valves, and the respective note pitches are determined by the combinations of these valves. The fingering patterns indicate the valve conditions, using the depressed valve number or numbers out of three valves #1, #2 and #3, while "0" meaning the condition where no valve is depressed. For example, the top record of FIG. 3 shows the fingering pattern of "0" for the notated note pitch of C5, which means that the trumpet produces the tone of the notated pitch C5 by depressing no valves as shown in FIG. 4*a*, i.e. when all the valves are at rest. The second record from the top of FIG. 3 shows the fingering pattern of "12" for the notated note pitch of C#5, which means that the trumpet produces the tone of the notated pitch C#5 which is a sermitone higher than the pitch of C5 by depressing the 1st valve and the 2nd valves as shown in FIG. 4*b*. The above example is of the trumpet, while different instruments may have different number of valves. The fingering pattern databases for other wind musical instruments may have different combinations of character strings depending on the number of valves provided in the instruments to indicate the fingering conditions for producing the tones of the respective notated note pitches.

Turning back to FIG. 1, the RAM 13 is used as a working memory for temporarily storing various data generated during execution of the programs by the CPU 11. The MIDI interface 14 is an interface for communicating MIDI signals between the apparatus and an external electronic musical instrument 21. Controls 22 include a mouse, a keyboard, etc. for various inputs by the user to the apparatus via the control circuit 15. A display device 23 is a computer display which is driven by the display circuit 16 according to the instructions from the CPU 11 to display various information.

The tone generator circuit 17 has a plurality of tone generation channels and is capable of generating a plurality of tone signals concurrently, receives data in the MIDI (musical instrument digital interface) format through the data bus 10, and generates musical tone signals based on the received MIDI data. The tone signals generated by the tone generator 17 are supplied to a sound system 24 including an amplifier and a loudspeaker, which in turn emit audible sounds. The communication interface 19 is connected to a wired or wireless communication network such as an LAN, the Internet and a telephone line. Thus, the apparatus can acquire music piece data and other data from a server computer (not shown) on the communication network.

The external storage device 18 is a hard disk drive which stores music piece information of individual music pieces. The music piece information on one piece of music, i.e. a data set (file) of a music piece contains a plurality of logical score information pieces and a string of performance information (or music-playing data). The logical score information is information indicating notes, rests and notational signs to display a transposed music score according to the time progression of the music piece. The music piece information for one piece of music contains a set of plural logical music score information pieces to display the respective transposed music scores for various instrument tonalities such as Bb, A and F. The performance information, on the other hand, is the information representing the contents of a music piece in the MIDI format.

FIG. 5 illustrates the data structure of the music piece information consisting of the logical music score information and the performance information. The logical music score information contains note data, rest data and notational sign data. The note data represent the note pitches as notated on the transposed music score and the durations of the respective notes. The durations are expressed by values representing relative lengths of the respective notes taking the duration of the quarter note as "1." For example, the first note in FIG. 5 has a duration of "2" and it means the length of two times a quarter note, i.e. the length of a half note, while the fourth note in FIG. 5 has a duration of "0.5" and it means the length of one half of a quarter note, i.e. the length of an eighth note. The pitches of the notes are expressed by values representing relative pitches of the respective notated notes in terms of semitones counted from the pitch of "C" which is expressed as "0." For example, the second note in FIG. 5 has a pitch value of "2" and it means the pitch two semitones above "C" i.e. the pitch of "D,"

while the fourth note in FIG. 5 has a pitch value of "4" and it means the pitch four semitones above "C" i.e. the pitch of "E."

The rest data represents the durations of the respective rests. The durations are expressed by values representing relative lengths of the respective rests taking the duration of the quarter rest as "1." The notational sign data represent manners for playing particular notes by placing respective notational signs in association with the notes to be played in the designated manners. There are two kinds of notational signs, one being the signs each to designate the manner of playing a single note and the other being the signs each to designate the manner of playing plural notes connected by the sign. The former kind includes a staccato, a tenuto, etc., and the latter kind includes a slur, a trill, an ornament, etc. The data of the former kind of notational sign is stored in correspondence to the data of a single note, while the data of the latter kind of notational sign is stored in correspondence to the data of a series of notes (hereinafter, a "note string") to be played in the manner designated by the sign. For example, in FIG. 5, the data of a slur sign is stored in association with the data of the first note and the second note, which means the note string consisting of the first and the second note should be played in slur (i.e. smoothly without a break).

The performance information contains pairs of an event data piece and a time data piece, the event data represents each of the events in the music progression such as a key-on event and a key-off event and the time data represents each of the processing times of the respective events in terms of the counts of a predetermined unit time interval. The event data and the time data are stored according to the time sequence of the music progression. In the embodiment, 480 counts of unit time intervals correspond to the duration of a quarter note. The data of each key-on event in the performance information is stored in association with the data of the corresponding note in the note information by means of a given ID (not shown).

Herein below will be described the operation of this embodiment. The operation roughly consists of two parts, music score display processing and fingering display processing. An example of the music score display processing is shown in a flow chart in FIG. 6. When the fingering guide displaying apparatus of this embodiment is started, the CPU 11 first causes, at a step S110, the display device 23 to display a screen image for selecting a musical instrument for learning the fingering methods thereof. The screen image contains, for example, a message like "Select a wind musical instrument you want to learn fingering of." and a list of wind musical instruments such as "Trumpet," "Clarinet" and "Hom." The learner moves the cursor on to the name of the instrument he/she wants to learn and select it.

The CPU 11 then reads out, at a step S120, a transposition value contained in the transposition value database (FIG. 2) stored in correspondence to the selected musical instrument in the ROM 12 and transfers to the RAM 13. For example, if the "trumpet" is selected, the transposition value "−2" which corresponds to the "trumpet" is read out from the ROM 12.

Then at a step S130, the CPU 11 causes the display device 23 to display a screen image for selecting a music piece. The screen image contains, for example, a message such as "Select a music piece you want to play in learning the fingering methods." and a list of the titles of the music pieces of which the music piece information is stored in the external storage device 18. The learner moves the cursor on to the title of the music piece he/she wants to play and select it. As the title is selected, the CPU 11 identifies the music piece information of the selected music piece in the external storage device 18.

Then at a step S150, the CPU 11 causes the display device 23 to display a transposed music score according to the logical music score information contained in the identified music piece information. More specifically, the processing goes as follows. The CPU 11 identifies the tonality of the musical instrument selected on the screen image for selecting a musical instrument based on the transposition value database, and reads out the logical music score information which corresponds to the identified tonality. Then the CPU 11 causes the display device 23 to draw a staff, refers to the note data and the rest data stored as the logical music score information in the sequential order of time series, and locates the notes and the rests having the durations defined by those data at the respective proper positions on the staff. Finally, the CPU 11 refers to the notational signs contained in the logical music score information, and if there are notational signs stored such as a slur, a trill, an ornament, a staccato, a tenuto, etc., draws such signs on to the corresponding note or note string.

At this time, the display device 23 displays a button labeled as "Start Playing" together with the picture of the transposing musical instrument. As the learner moves the cursor on to this button and selects it, the CPU 11 starts to play back the music piece. In other words, the CPU 11 refers to the performance information (FIG. 5) contained in the music piece information as identified at the step S140, and sequentially processes the respective event data in the performance information at the respective times as indicated by the time data which is paired with the event data, and successively outputs the musical tone signals generated by such processing. The generation of the musical tone signals are performed according to the well known MIDI signal processing technology. When the "Start Playing" button is selected (clicked), the fingering display processing which is the characteristic processing of this embodiment is conducted along with the processing for playing back the music piece.

FIG. 7 shows a flow chart describing an example of fingering display processing. This processing is performed every time the key-on event data is read out from the performance information. When a piece of key-on event data is read out from the performance information, the CPU 11 identifies, at a step S210, the note which corresponds to that piece of key-on event data out of the group of notes on the transposed music score displayed on the display device 23. As described above, the note information and the key-on event data are associated with each other so that the one-to-one correspondence is kept between the respective notes and the respective key-on events by common ID's, respectively. Therefore, by referring the note information having the same ID as the read-out key-on event data, the CPU 11 can uniquely identify the note on the transposed music score.

The CPU 11 acquires, at a step S220, the key code of the actual note pitch represented by the read-out key-on event data piece. The CPU 11 then adds, at a step S230, to the acquired key code a value which is obtained by reversing the sign of the transposition value as transferred to the RAM 130 at the step S120 of FIG. 6. In other words, the actual note pitch represented by the key code is transposed in accordance with the tonality of the wind musical instrument to obtain a modified note pitch on the transposed music score for the instrument to sound the tone of the same pitch. And then, the CPU 11 read out, at a step 240, the fingering pattern, which accords with the note pitch identified by the resultant key code obtained by adding the opposite-signed transposition value from the fingering pattern database. Finally, the CPU 11 causes the display device 23 to display, at a step S250, the fingering pattern represented by the read-out fingering pattern data below the note as identified at the step S210. The above described series of processing will take place repeatedly, every time the key-on event data is read out from the performance information.

A more detailed description will be made hereunder about the fingering display processing referring to a specific example of transposed music score displayed on the display device 23. For example, let us assume that a "trumpet" is selected on the musical instrument selecting screen, and that a transposed music score for the instrument tonality of Bb (for trumpet). The transposed music score notates the notes which are respectively two semitones higher than the respective notes in the reference tonality, i.e. the key of C, as shown in FIG. 8*a*. In order to play the note #1 on the transposed music score of FIG. 8*a*, the fingering pattern for the pitch which is two semitones higher than the actual pitch represented by the key code. More specifically, the key code C5 of the actual pitch is acquired from the performance information at the step S220 of FIG. 7, and to this acquired key code is added a value "2" which is obtained by reversing the sign of the transposition value "−2" which means the instrument tonality Bb of the trumpet at a step S230. Then the resultant key code will be D5, and the fingering pattern "1" (FIG. 3) is read out at a step S240. Finally, the character string "1" which represent the fingering pattern for the trumpet is placed below the note #1 on the transposed music score at a step S250. The learner now understands that the first valve is to be depressed to play the note #1 notated on the transposed music score.

Embodiment 2

A second embodiment of the fingering guide display apparatus according to the present invention is characterized in that it displays the fingering guide not only in the form of character strings but also in the form of graphics and further in that it displays also alternative fingering patterns together with the standard fingering patterns for the note pitches if there is or are alternative fingering pattern or patterns available in addition to the standard fingering pattern for the same pitch.

The hardware configuration of the fingering guide display apparatus as the second embodiment of the present invention is the same as that of the first embodiment shown in FIG. 1 except for the data contents stored in the ROM 12. According to this embodiment, the ROM 12 stores a fingering pattern database containing the data contents as shown FIG. 9 in addition to the transposition value database of FIG. 2. As shown in FIG. 9, each record of the fingering pattern database of this embodiment has fields of "notated pitch," "standard fingering pattern" and "alternative fingering pattern." The field of "alternative fingering pattern" is subdivided into three subfields of "1st alternative fingering pattern," "2nd alternative fingering pattern" and "3rd alternative fingering pattern."

The field of "notated pitch" contains data indicating note pitches to be notated on the music score of the wind musical instrument as in the case of the first embodiment (FIG. 3). The field of "standard fingering pattern" contains data indicating the standard fingering patterns for the respective notated pitches. The standard fingering pattern is a character string which is unique to each note pitch and indicates the valve or valves to be depressed for playing the note pitch in a standard or usual manner. The fields of "1st alternative fingering pattern," "2nd alternative fingering pattern" and "3rd alternative fingering pattern" data respectively indicating different fingering patterns for each notated pitch as far as there are so many different fingering patterns. The alternative fingering pattern is a character string indicating the valve or valves to be depressed for playing the same note pitch in an alternative manner other than the standard manner. For example, in the database of FIG. 9, the record of the notated pitch D5 has a character string "1" at the field of the standard fingering pattern, a character string "3" at the field of the 1st alternative fingering pattern, and a value NULL at the field of the 2nd alternative fingering pattern. This means that, there is an alternative fingering pattern of depressing the 3rd valve available for playing the note pitch of D5 in addition to the standard fingering pattern of depressing the 1st valve. The value of "NULL" means there is no 2nd or further alternative fingering pattern available for the note pitch of D5. In this embodiment, the ROM 12 also stores data to display images of the respective conditions of the instrument as fingered according to the respective fingering patterns, in association with the data of the respective fingering patterns.

This embodiment operates as follows. FIG. 10 shows a flow chart describing an example of fingering graphic display processing, which is similar to but partly different from the processing flow of the first embodiment. After the step S230 of adding an opposite-signed transposition value to the key code of the actual note pitch, the CPU 11 identifies a record of the note pitch which accords with the resultant key code after the addition from the fingering pattern database in the ROM 12 at a step S310.

Then at a step S320, the CPU refers to the identified record and judges whether there is an alternative fingering pattern available for the note pitch. This judgment will be made by referring to the field of "1st alternative fingering pattern" of the identified record. If this field contains a "NULL" value, that means there is only a standard fingering pattern available and no alternative fingering pattern available. If the judgment is that there is no alternative fingering pattern available, the CPU 11 reads out the data of a standard fingering pattern from the field of "standard fingering pattern" of the identified record, and causes the display device 23 to display the fingering pattern as indicated by the data of a standard fingering pattern below the note as identified on the transposed music score at the step S210 of FIG. 7, at a step S330.

On the other hand, if the judgment is that there is any alternative fingering patterns available, the CPU 11 reads out the data of a standard fingering pattern and alternative fingering patterns from the field of "standard fingering pattern" and "alternative fingering pattern" of the identified record, and causes the display device 23 to display a list which enumerates those fingering patterns below the note as identified on the transposed music score at the step S210 of FIG. 7, at a step S340. The learner moves the cursor to one of the enumerated fingering patterns in the list to select the same.

Then at a step S350, the CPU 11 reads out the data of a fingering image stored in the ROM 12 in association with the selected fingering pattern, and causes the display device 23 to display a fingering graphic created from the fingering image data. Thus, the learner can visually understand the specific fingering pattern as selected from the list of candidates.

Embodiment 3

A third embodiment of the fingering guide display apparatus according to the present invention is designed specifically for learning fingering methods on a clarinet which is one of the transposing musical instruments in the Bb tonality. The third embodiment is characterized in that it displays different graphics of fingering guide on the display device 23 between the time a music piece is being played back (hereinafter, playback condition) and the time the playback of a music piece is at a stop (hereinafter, play-stop condition). More particularly, during the playback of a music piece, the display device 23 displays the fingering patterns and the fingering graphics (or graphic fingering guide image) of both of the note which the learner is to play currently (hereinafter, current note) and the note which the learner is to play subsequent to the current note among the notes displayed on the transposed music score, whereas during the play-stop of a music piece, the display device 23 displays fingering graphics (or graphic fingering guide image) corresponding to notational signs such as a trill and an ornament and alternative fingering graphics for the same.

The hardware configuration of the fingering guide display apparatus as the third embodiment of the present invention is the same as that of the first embodiment shown in FIG. 1 except for the data contents stored in the ROM 12. According to this embodiment, the ROM 12 stores a transposition value database, a fingering pattern database, a trill fingering database and an ornament fingering database. The data contents of the transposition value database is the same as the database of FIG. 2, and the data contents of the fingering pattern database is the same as the database of FIG. 9.

FIG. 11 shows a table illustrating the data structure of a trill fingering database. Each record of the trill fingering database of this embodiment has fields of "notated pitch" and "trill fingering." The field of "notated pitch" contains the data representing the notated pitch of the clarinet. On the other hand, the field of "trill fingering" is subdivided into two subfields of "interval 1" and "interval 2," each of which in turn is further subdivided into further subfields of "standard fingering pattern" and "alternative fingering pattern." The further subfield of "standard fingering pattern" contains data representing standard trill fingering pattern. The standard trill fingering pattern is a character string which indicates a standard fingering pattern for the trill playing for each notated pitch. The alternative fingering pattern contains data representing alternative trill fingering pattern. The alternative trill fingering pattern is a character string which indicates an alternative fingering pattern for the trill playing for each notated pitch. The "interval 1" and the "interval 2" discriminate two kinds of trill playing, wherein the "interval 1" corresponds to a semitone trill, and the "interval 2" corresponds to a whole tone trill. The configuration of the ornament fingering database is similar to the trill fingering database, and the specific description thereof with reference to drawings will be omitted herein. The ROM 12 stores image data representing a clarinet in the condition of executing the respective fingerings (trill fingering and ornament fingering) in correspondence to each fingering pattern.

Hereinafter will be described how the third embodiment operates. The operation of this embodiment contains two different modes of processing. One is the fingering guide displaying processing in the playback condition which is performed during the time a music piece is being played back, whereas the other is the fingering guide displaying processing in the play-stop condition which is performed during the time the playback of a music piece is at a stop. In other words, with this embodiment, the fingering guide displaying processing is performed in parallel with the processing of playing back a music piece, but if the stoppage of playing back a music piece is inputted (commanded) from the controls 22 in the middle of the processing of playing back, the fingering guide displaying processing in the playback condition is temporarily suspended and the fingering guide displaying processing in the play-stop condition is performed.

The fingering guide displaying processing starts as triggered by the selection (or designation) of a button named "Start Playing" on the screen image in the condition that the graphic fingering guide image is being displayed on the display screen 23. The graphic fingering guide image will be first described with reference to FIG. 12. The image includes a transposed music score display area 23*a* for displaying a transposed music score for the transposing musical instrument, a first fingering graphic display area 23*b* for displaying the image of the musical instrument to be fingered to play the current note of the notated pitch on the transposed music score, and a second fingering graphic display area 23*c* for displaying the image of the musical instrument to be fingered to play the subsequent note of the notated pitch on the transposed music score or the image of an alternative fingering to play the same note as the area 23*b*. And above the transposed music score display area 23*a*, there is a button 23*d* named "Start Playing." And above the first fingering graphic display area 23*b*, there are a fingering pattern selecting box 23*e*, an interval indicating box 23*f*, an ornament button 23*g* and a trill button 23*h*.

FIG. 13 shows a flow chart describing an example of fingering graphic display processing during the playback of a music piece. As the "Start Playing" button 23*d* is selected, the CPU 11 caused the display device 23 to display a graphic image which indicates the fingering pattern for the current note in the first fingering graphic display area 23*b* at a step S410. More specifically, the processing is performed as follows. First, the CPU 11 reads out key-on event data to be processed at the next MIDI clock timing from among the event data stored in the sequence of MIDI format performance information contained in the music piece information in the external storage device 18, and transfers to the RAM 13. Then, the CPU 11 obtains a transposed key code according to the similar steps as the steps S220 and S230 of FIG. 7, and identifies a record which accords with the obtained key code out of the fingering pattern database. And then, the CPU 11 reads a fingering pattern from the field of "standard fingering pattern" in the identified record, and draws a fingering guide graphic based on the fingering graphic data which corresponds to the read-out fingering pattern to display thus drawn graphic in the first fingering graphic display area 23*b*.

Then at a step S420, the CPU 11 causes the display device 23 to display a graphic image which indicates the fingering pattern for the subsequent note in the second fingering graphic display area 23*c*. That is, the CPU 11 reads out the key-on event data which is stored next to the key-on event data which is transferred to the RAM 13 at the step S410 as described above, and transfers the read-out subsequent key-on event data to the RAM 13 and causes the display device 23 to display a fingering guide graphic drawn according to the similar procedure as mentioned above now in the second fingering graphic display area 23*c*.

FIG. 14 illustrates a screen image of a graphic fingering guide in which the graphic presentation of the fingering pattern for the current note and the same for the subsequent note are displayed in combination. As shown in FIG. 14, the first and second fingering graphic display areas 23*b* and 23*c* depict clarinet graphics with the keys to be depressed in the respective fingering patterns for the respective notes hatched. In this instance, triangular buttons on the right of the fingering pattern selecting box 23*e*, triangular buttons on the right of the interval indicating box 23*f*, the ornament button 23*g* and the trill button 23*h* are all locked unoperatable.

When the CPU 11 detects that a tone which corresponds to the current note has been generated, namely that the tone signal obtained by processing the key-on event data of the current note has been outputted to the tone generator circuit 17, the CPU 11 shifts the graphic image which indicates the fingering pattern of the subsequent note up to the current note area at a step S430. In other words, the graphic image heretofore displayed in the second fingering graphic display area 23*c* are now shifted to the first fingering graphic display area 23*b*. Thereafter, the process flow goes back to the step S420, and the CPU 11 now reads the further next key-on event data to handle the corresponding note to be a new subsequent note and causes the display device to display the graphic representing the fingering pattern for such a new subsequent note in the second fingering graphic display area 23*c*. The above-described processing is performed in parallel with the processing for playing back the music piece.

FIGS. 15*a* and 15*b* show, in combination, a flow chart describing an example of fingering graphic display processing during the play-stop of a music piece. The fingering graphic display processing in the play-stop condition is initiated as triggered by the detection of an input of play-stop command from the controls 22. When an input of play-stop command is detected, the CPU 11 masks with a predetermined color the fingering graphic displayed in the second fingering graphic display area 23*c* of the graphic fingering guide image at a step S510 and renders the buttons on the right of the fingering pattern selecting box 23*e*, the buttons on the right of the interval indicating box 23*f*, the ornament button 23*g* and the trill button 23*h* active. To make buttons active means that the buttons are released from the locked condition of operation. Thus, the learner can now select the trill button 23*h* and the ornament button 23*g* placing and clicking the cursor thereon and change the indicated contents of the interval indicating box 23*f* and of the fingering pattern selecting box 23 by clicking the buttons on the right of these boxes, respectively.

FIG. 16 illustrates a screen image of a graphic fingering guide in the condition where the second fingering graphic display area 23*c* is masked. As shown in FIG. 16, only the graphic in the first fingering graphic display area 23*b* can be referenced. In this condition, the contents of the fingering pattern selecting box 23*e* can be successively changed from "Standard Fingering Pattern" to "Alternative Fingering Pattern 1," to "Alternative Fingering Pattern 2," and to "Alternative Fingering Pattern 3," and the contents of the interval indicating box 23*f* can be changed from "2" to "1" and vice versa. Under these conditions, the CPU 11 detects whether the indicated content of the fingering pattern selecting box 23*e* is changed, and, when changed, displays a fingering graphic in the first fingering pattern display area 23*b* according to the changed content at a step S520. More specifically, when the content of the fingering pattern selecting box 23*e* is changed to "Alternative Fingering 1," the fingering graphic corresponding to the "First Alternative Fingering Pattern" is displayed in the first fingering graphic display area 23*b*, whereas when the content of the fingering pattern selecting box 23*e* is changed to "Alternative Fingering 2," the fingering graphic corresponding to the "Second Alternative Fingering Pattern" is displayed in the first fingering graphic display area 23*b*.

Further, the CPU 11 detects whether the trill button 23*h* is selected (clicked), and when the trill button 23*h* is selected, the CPU 11 acquires the interval number currently exhibited in the interval indicating box 23*f* at a step S530 and causes the display device 23 to display a graphic which indicates the trill fingering pattern corresponding to the acquired interval number at a step S540. More specifically, the CPU 11 acquires a new key code according a similar procedure as the steps S220 and S230 of FIG. 7 out of the key-on event data of the performance information transferred to the RAM 13, and identifies a record of the note pitch which corresponds to the new key code in the trill fingering database. Then, the CPU 11 further identifies the field which corresponds to the interval number as acquired at the step S530 from among the identified record. And the CPU 11 reads out the standard trill fingering pattern data from the identified field, and draws a fingering graphic based on the fingering image data which corresponds to the read-out standard trill fingering pattern data and displays the drawn fingering graphic in the second fingering graphic display area 23*c*.

FIG. 17 illustrates a screen image of a graphic fingering guide in which a graphic indicating a trill fingering pattern is displayed. As shown in FIG. 17, when the trill button 23*h* is selected (clicked), a graphic guide of a trill fingering pattern is displayed in the second fingering graphic display area 23*c* which has heretofore been masked. Further, the fingering pattern selecting box 23*e* indicates "Trill Standard." This indication can be change to "Trill Alternative" by clicking the buttons on the right of the fingering pattern selecting box 23*e*.

The CPU 11 judges whether the fingering pattern selecting box 23*e* is changed to "Trill Alternative," and when the indication is changed, causes the display device to display a graphic which represents the alternative fingering pattern for the trill playing at a step S550. More specifically, the CPU 11 reads out the alternative trill fingering pattern data out of the record identified at the step S540, and draws a graphic based on the fingering pattern image data which corresponds to the read-out alternative trill fingering pattern data so that the second fingering graphic display area 23*c* will exhibit the drawn graphic. FIG. 18 illustrates a screen image of a graphic fingering guide for a trill playing in an alternative way. Under this condition, the displayed contents of the second fingering graphic display area 23*c* is changed to a graphic which shows the alternative trill fingering pattern, and the fingering pattern selecting box 23*e* indicates "Trill Alternative."

The CPU 11 further detects whether the ornament button 23*g* is selected (clicked) or not, and when selected, the CPU 11 acquires the interval number currently exhibited in the interval indicating box 23*f* at a step S560, and causes the display device 23 to display a graphic which indicates the fingering pattern for the ornament note corresponding to the acquired interval number in the second fingering graphic display area 23*c* at a step S570. Further under this condition, if the content of the fingering pattern selecting box 23*e* is changed to "Ornament Alternative," the graphic image which indicates the alternative ornament fingering pattern is exhibited in the second fingering graphic display area 23*c* at a step S580. The specific contents of the series of processes for the ornament playing is almost the same as the processes at the steps S530 through S550 except for the database to be referenced being an ornament fingering database. The CPU 11 next detects an input of the command of clearing the play-stop condition, and if the command of clearing the play-stop condition is inputted, the CPU 11 resumes the fingering graphic processing during playback shown in FIG. 13.

Although the third embodiment has been described in connection with the clarinet, the embodiment is applicable to other wind musical instruments with some modifications according to the instruments, which will be apparent to those skilled in the art.

Embodiment 4

A fourth embodiment of the fingering guide display apparatus according to the present invention is designed specifically for learning fingering methods on a horn which is one of the transposing musical instruments in the Bb tonality. The fourth embodiment is characterized in that it displays an optimum sequence of fingering patterns automatically determined for consecutive notes which are connected by a slur sign, utilizing the physical information of the musical instrument in addition to the logical score information contained in the music piece information. A slur is a connective sign covering two or more successive notes of different pitch to be played smoothly without a break. The physical information herein means information which represent the physical conditions of the musical instrument quantitatively when the instrument is played using respective fingering patterns. Specifically, the physical conditions include the resonance modes and the valve slide tube lengths of the horn.

The horn has three valves each for switching the use or nonuse of each associated valve slide tube of its unique length, which provides eight different fingering patterns, which in turn form seven different tube lengths (as two of the eight fingering patterns form a generally identical tube length). According to the player's embouchure, different mode of resonance (of the harmonic series) can be controllably established to produce different pitches for the same fingering pattern. The combinations of the embouchure and the valve fingering patterns (with some aid by a night hand placed into the bell) will cover all the available notes to be played on the horn. Where the consecutive notes are connected by a slur sign, the player plays a given note using a fingering pattern assigned to the given note and a proper embouchure for the aimed pitch of the given note, and then changes the fingering pattern and/or the embouchure for the succeeding note with the continuous blow (i.e. without a break). Generally speaking, an advanced player who can manipulate the resonance mode change at will would prefer a resonance mode change rather than a fingering pattern change to play the slurred notes, whereas a beginner would prefer a valve slide change rather than a resonance mode change, as the latter is harder than the former.

This embodiment reflects the physical characteristics of the horn in determining the fingering patterns. The hardware configuration of the fingering guide display apparatus according to the fourth embodiment of the present invention is the same as that of the first embodiment shown in FIG. 1 except for the data contents stored in the ROM 12. According to this embodiment, the ROM 12 stores a transposition value database and a physical information database.

FIG. 19 illustrates the data structure of the physical information database. Each of the records constituting this database has a field of a notated pitch and eight fields of fingering patterns corresponding to the above-mentioned eight different patterns of the fingering. The field of "notated note" contains data representing a note pitch notated on the music score for the horn. It should be noted that music scores for the horn are described in the tonality of F both for the horn in F and the horn in Bb. On the other hand, each of the fields of the fingering patterns is named with three digits of numerals, which indicate the numbers of the valves to be depressed in which the leftmost digit represents the first valve, the middle digit the second valve and the rightmost digit the third valve. For example, the name of the second fingering pattern field of the database says "Fingering Pattern (010)" and this means that only the finger button of the second valve is depressed.

In this embodiment, the second valve corresponds to the shortest valve slide and the third valve corresponds to the longest valve slide. In the case of a horn, generally, with reference to the condition where no valve slides are connected (this corresponds to the pattern "000"), the condition where only the shortest valve slide is connected (this corresponds to the pattern "010") produces the pitch which is a semitone lower, the condition where only the medium long valve slide is connected (this corresponds to the pattern "100") produces the pitch which is two semitones lower, and the condition where only the longest valve slide is connected (this corresponds to the pattern "001") produces the pitch which is three semitones lower. Accordingly, including the combined use of the valve slides, there are eight conditions established by eight fingering patterns, i.e. "000," "010," "100," "110," "001," "011," "101" and "111," which are enumerated in order of high-to-low of the pitch. As will be understood from the above description about the valve slides, the fingering patterns "110" and "001" produces a substantially same pitch.

As shown in FIG. 19, the physical information database contains a set of resonance mode information, valve slide tube length information and preference degree information in each of the fields of the available fingering patterns with respect to each of the records of the notated note pitches. The resonance mode information represents the harmonic order of resonance to produce the pitch. The valve slide information represents the use of the slide valves, in which L1 means the length of the first valve slide, L2 the second valve slide and L3 the third valve slide. For example, where the first and second valves are depressed, the valve slide length information is described as "L1 +L2." The preference degree information represents degrees of preference to be used for producing the pitch from the viewpoint of pitch accuracy, and expressed by a double circle mark, a single circle mark and a triangle mark. The double circle mark represents the standard fingering pattern which produces a pitch of the best accuracy. The single circle mark represents an alternative fingering pattern as the second best fingering pattern which produces a pitch of a rather good accuracy although not so good as the double circle mark. The triangle mark represents a further alternative fingering pattern which can produce the pitch but in a bad accuracy.

For example, the record of the notated note pitch of "Ab4" in this database contains at the field of "Fingering Pattern (010)" the resonance mode information "5" and the preference degree information "a single circle," and also at the field of "Fingering Pattern (011)" the resonance mode information "6" and the preference degree information "a double circle." This indicates that the notated pitch "Ab4" can be produced in two ways using either the fingering pattern "010" or "011," whereby the player should blow the horn to establish the 5th resonance mode in the case of the fingering pattern "010," while the player should blow the horn to establish the 6th resonance mode in the case of the fingering pattern "011," and that the latter case produces the pitch in a better accuracy than the former case.

The operation of this embodiment will be described hereinafter. In the following description, a pair of the resonance mode information and the valve slide length information is referred to as physical information for the sake of convenience. FIGS. 20*a* and 20*b* describe, in combination, a flow chart of the fingering display processing according to this embodiment. As the initiation of the fingering guide displaying apparatus according to this embodiment is commanded, the CPU 11 first causes the display device 23 to display a screen image for inviting the selection of a method for narrowing down the candidates at a step S610. The screen image is to invite the learner to select a method for narrowing down the candidates when there are more than one candidate of the combination of fingering patterns for the consecutive notes connected with a slur. The screen image contains two buttons, "Method 1" and "Method 2," and a massage inviting the selection of either of the two. The learner places the cursor on either of the button and select one. The details of the two methods are as follows.

Method 1:

This method is to narrow down the fingering pattern candidates by preferentially permitting fingering pattern changes to cause the change in length of the valve slides rather than permitting fingering pattern changes to cause the change in the resonance mode. In this method, therefore, a combination of fingering patterns which assumes a minimal difference in the resonance modes among the two physical conditions of the resonance mode and the valve slide length.

Method 2:

This method is to narrow down the fingering pattern candidates by preferentially permitting fingering pattern changes to cause the change in the resonance mode rather than permitting fingering pattern changes to cause the changes in length of the valve slide. In this method, therefore, a combination of fingering patterns which assumes a minimal difference in the valve slide length among the two physical conditions of the resonance mode and the valve slide length.

After the method is selected, the CPU 11 causes the display device 23 to display a transposed music score at a step S620. The transposed music score is created based on the logical music score information contained in the music score information stored in the external storage device 18. The contents of the transposed music score is the same as mentioned in the first embodiment with reference to FIG. 6.

The learner moves the cursor on to a particular note on the transposed music score displayed on the display device 23 and selects the note. After the note is selected by the learner, the CPU 11 judges whether the note sequence including the selected note and the preceding and/or succeeding note are connected by a slur based on the logical music score information at a step S630. As described with reference to FIG. 5, the logical music score information contains the data of a note or a sequence of notes to be played in a particular playing manner and the data of a notational sign to indicate such a playing manner as associated with each other, and accordingly if the selected note is associated with a slur sign, the judgment will be that the selected note is to be played in a slurred fashion.

If the selected note is not connected by a slur, the CPU 11 identifies at a step S640 a record to refer out of the physical information database based on the event data which corresponds to the selected note. More specifically, the CPU 11 identifies the key-on event data which corresponds to the selected note out of the performance information, and adds the opposite-signed value "+7" of the transposition value "−7" for the horn to the key code represented by the key-on event data to obtain a new key code, and then identifies the record of the notated pitch having thus obtained new key code out of the physical information database. Then at a step S650, the CPU 11 identifies a field which stores physical information among the eight field constituting the identified record and causes the display device 23 to display the fingering pattern having such a name of the identified field on to the transposed music score. In case two or more fields are identified, the field name of the field which contains the double circle mark as the preference degree information.

If consecutive notes are connected by a slur, the CPU 11 identifies the records to refer with respect to the respective notes based on the respective event data which correspond to the respective ones of the connected notes at a step S660. Specific processes to identify the records are the same as explained about the step S640. Then at a step S670, the CPU 11 identifies one or more fields containing physical information data from among eight fields in the respective records identified with respect to the respective notes. Then, the CPU 11 reads out the physical information contained in the respective identified fields of each of the notes at a step S680.

If there are two or more combinations of the fingering patterns represented by the field or fields as identified with respect to each of the notes, the CPU 11 narrows down those combinations into the one which assumes the smallest difference in the change of physical information between the consecutive notes at a step S690. The narrowing down process is performed by obtaining the differences of the physical conditions represented by the physical information read out at the step S680 with respect to each combination of the fingering patterns. In such processing, if "method 1" has been selected in the above described method of selecting screen image, the selection is conducted so that the combination of the fingering patterns which assumes the minimal difference in the change of resonance modes represented by the resonance mode information contained in the physical information should be determined, whereas if "method 2" has been selected, the selection is conducted so that the combination of the fingering patterns which assumes the minimal difference in the change of valve slide lengths represented by the valve slide length information contained in the physical information should be determined. If the combination of the fingering patterns is not narrowed down to one at the step S690, the CPU 11 conducts a further narrowing process based on the preference degree information in the physical information database at a step S700. And finally, the CPU 11 identifies both the fields which correspond to the combination as narrowed down through the above described processing, and causes the display device 23 to display the fingering patterns represented by the names of both the identified fields on to the transposed music score in the progressing order of the notes to be played.

Now will be described more specifically how the processing goes in the case where a transposed music score as shown in FIG. 21 is being displayed on the display device 23. As shown in FIG. 21, note #1 and note #2 are connected by a slur sign. When these two notes are subject to the processing, the judgment after the step S630 in FIG. 20*a* turns out to be affirmative (YES), and the process flow goes forward to a step S660. At the step S660, record "G5" to be referred with respect to note #1 and record "A5" to be referred with respect to note "#2" are identified out of the physical information database, respectively.

According to the record of "G5," the notated note pitch of "G5" can be produced by using any of four fingering patterns, "000" (9th mode, 0, double circle), "100" (10th mode, L1, single circle), "011" (11th mode, L2+L3, single circle) and "101" (12th mode, L1 +L3, single circle). And according to the record of "A5," the notated note pitch of "A5" can be produced by using any of six fingering patterns, "000" (10th mode, 0, single circle), "100" (11th mode, L1, single circle), "110" (12th mode, L1+L2, double circle), "001" (12th mode, L3, single circle), "101" (13th mode, L1+L3, single circle) and "111" (14th mode, L1+L2+L3, single circle). This means that there are twenty-four (24) combinations of fingering patterns to play the note #1 and note #2 consecutively. In this connection, the narrowing down processes at the steps S690 and S700 are performed.

The narrowing down processes will be different depending upon the selected one among Method 1 and Method 2 for narrowing down the candidate fingering patterns as described hereinbefore.

"Method 1" is to narrow down the fingering pattern candidates by preferentially permitting fingering pattern changes to cause the change in length of the valve slides rather than permitting fingering pattern changes to cause the change in the resonance mode. In view of such conditions of Method 1, there are four combinations which do not cause changes in resonance mode, which are the combination of "100" (10th mode, L1, single circle) and "000" (10th mode, 0, single circle), the combination of "011" (11th mode, L2+L3, single circle) and "100" (11th mode, L1, single circle), the combination of "101" (12th mode, L1+L3, single circle) and "110" (12th mode, L1+L2, double circle), and the combination of "101" (12th mode, L1+L3, single circle) and "001" (12th mode, L3, single circle) among the twenty four candidates. Accordingly, the twenty four candidate combinations are narrowed down to these four combinations at the step S690. The following step S700 further narrows down these four combinations into one combination of "101" (12th mode, L1+L3, single circle) and "110" (12th mode, L1+L2, double circle) which include the preference degree of the double circle meaning the best accuracy in pitch.

"Method 2" is to narrow down the fingering pattern candidates by preferentially permitting fingering pattern changes to cause the change in the resonance mode rather than permitting fingering pattern changes to cause the changes in length of the valve slide. In view of such conditions of Method 2, there are three combinations which do not cause changes in length of the valve slide, which are the combination of "000" (9th mode, 0, double circle) and "000" (10th mode, 0, single circle), the combination of "100" (10th mode, L1, single circle) and "100" (11th mode, L1, single circle), the combination of "101" (12th mode, L1+L3, single circle) and "101" (13th mode, L1+L3, single circle). Accordingly, the twenty four candidate combinations are narrowed down to these three combinations at the step S690. The following step S700 further narrows down these three combinations into one combination of "000" (9th mode, 0, double circle) and "000" (10th mode, 0, single circle) which include the preference degree of the double circle meaning the best accuracy in pitch.

A further example will be described. Note #3 in the transposed music score of FIG. 21 is not connected by a slur with either the preceding note or the subsequent note. Therefore, when this note is subject to the processing for determining a fingering pattern, the judgment after the step S630 (FIG. 20) is negative (NO) and the process flow proceeds to the step S640, which in turn identifies the record "G5" to be referred for the note #3. According to the record of "G5," the notated note pitch of "G5" can be produced by using any of four fingering patterns, "000" (9th mode, 0, double circle), "100" (10th mode, L1, single circle), "011" (11th mode, L2+L3, single circle) and "101" (12th mode, L1+L3, single circle). The most preferential fingering pattern among these is "000" (9th mode, 0, double circle) and accordingly the step S650 identifies this field.

According to the fourth embodiment in connection with the horn, fingering pattern for consecutive notes are determined taking the differences in physical conditions of fingering patterns between the consecutive notes in consideration, and therefore the fingering guide displaying apparatus will give the learner a proper fingering pattern progression in view of the learner's skill level. Although the fourth embodiment has been described above with respect to the horn specifically, it should be understood by those skilled in the art that the idea of this embodiment may be utilized for other kinds of musical instruments.

Further Embodiments

Various modifications may be possible within the spirit of the present invention. For example, whereas the fingering pattern database of FIG. 9 contains up to three alternative fingering patterns, the number of fields for the alternative fingering patterns may be increased to four or more to prepare more available fingering patterns for the learner. Similarly, whereas the trill fingering database of FIG. 11 contains only one alternative fingering pattern for the trill playing of a given note at a given interval, more alternative fingering patterns may be provided for each given note at each given interval.

Whereas in the third embodiment, the second fingering graphic display area 23*c* is masked with a predetermined color when a play-stop command is detected, the masking may be modified as graying out.

Whereas in the fourth embodiment, the physical information is utilized to present a proper combination of fingering patterns where consecutive notes are connected with each other by the notational sign of a slur on the transposed music score, the case where a note is marked with another notational sign such as a trill or an ornament indicating the alternating playing of consecutive notes may be handled in the same way as the slurred notes.

Whereas in the second embodiment, where there are plural fingering patterns for one note pitch, those fingering patterns are listed for selection, but alternatively the plural fingering patterns may be prioritized according to a predetermined criterion before listing.

Whereas in the first and the second embodiment, the fingering patterns are displayed successively for the respective notes to be played in accordance with the progression of the music piece playing, the fingering patterns may be displayed only when the music piece playing is stopped.

In the above described embodiments, the music piece information of a piece of music contains plural strings of logical music score information and a string of performance information, and the note pitches to be notated on the transposed music score are acquired from the logical music score information while the actual note pitches corresponding to the respective notated note pitches are acquired from the key-on event data contained in the performance information in the form of a MIDI data sequence. Alternatively, the logical music score information may not be provided for the respective tonalities of the transposing musical instruments, a sequence of notes to be drawn on the transposed music score and a notational sign or signs to be associated with one or more of those notes may be identified based on the performance information. An example of the procedure of generating a transposed music score based on the performance information may be as follows. The performance information data are expanded on the RAM 13, a pair of the note-on event data and the note-off event data is considered to represent one note, and the duration of the note is determined based on the value of the time data which is stored in a set with the note-off event data. Then, by applying transposition values read out from the transposition value database to the actual note pitches represented by the note-on event data, the locations on the transposed music score of the respective notes having the above-determined durations are determined, and the notes are drawn on the music score. Furthermore, when there are no (or substantially no) time gap between the key-off event of a note and the key-on event of the next note, it should be understood that these two notes are to be played as connected notes, and accordingly a notational sign to indicate the smooth playing of the notes such as a slur sign may be placed around those drawn notes on the music score. Even though the logical music score information is not stored, the above described embodiments can operate to present fingering patterns for the transposing musical instruments, as long as the key-on event data corresponding to the respective notes represent actual note pitches.

To sum up, the characteristic operation unique to the present invention that a fingering pattern for a given note on a transposed music score is extracted from a database and exhibited on the transposed music score by the given note, by obtaining a transposed note pitch from the application of a transposition value to the actual note pitch contained in the performance information corresponding to the given note can be realized, only if the external storage device 18 or the ROM 12 stores the data which define the respective notes which constitute a music piece and which are named in the tonality of C (music piece constituting note defining information).

The note names are herein expressed in a widely prevailing engineering method taking the middle C as "C4," using capital letters of alphabet plus octave number. But, any other nomenclature may be used to identify the notes. For example, German nomenclature (C, Cis, D, Es, . . . ), Italian nomenclature (Do, Di, Re, Mu, . . . ), Japanese nomenclature, or other nomenclature may be used. Further, all the notes may be expressed using relative pitch differences from a certain reference pitch (0, 1, 2, 3, . . . ).

While particular embodiments of the invention and particular modifications have been described, it should be expressly understood by those skilled in the art that any of the illustrated embodiments may be combined together and that various modifications and substitutions may be made without departing from the spirit of the present invention so that the invention is not limited thereto, since further modifications may be made by those skilled in the art, particularly in light of the foregoing teachings. It is therefore contemplated by the appended claims to cover any such modifications that incorporate those features of these improvements in the true spirit and scope of the invention.

What is claimed is:

1. A fingering guide displaying apparatus comprising:

a display device;

a storage device for storing music piece constituting note data which represent a group of notes to constitute a music piece as expressed according to a nomenclature in a reference tonality, transposition data which represent for at least one transposing musical instrument a pitch difference between said reference tonality and an instrument tonality which is unique to said transposing musical instrument, and fingering pattern data which represent fingering patterns for available notes of said transposing musical instrument as expressed in a nomenclature in said instrument tonality;

a play note identifying device for identifying notes to be played at respectively given times out of said group of notes represented by said music piece constituting note data;

a note pitch shifting device for reading out said transposition data from said storage device, and respectively transposing the pitches of said identified notes by the amount of said pitch difference represented by said transposition data to obtain respectively shifted note pitches which are expressed in the nomenclature in said instrument tonality and which are respectively identical with the pitches of said respectively identified notes as expressed in said reference tonality; and a display control device for reading out from said storage device said fingering pattern data representing fingering patterns which respectively correspond to said shifted note pitches obtained by said note pitch shifting device, and causing said display device to display said fingering patterns represented by said read-out fingering pattern data.

2. A fingering guide displaying apparatus according to claim 1, wherein said display control device causes said display device to display each of said fingering patterns in at least one of the form of a character string indicating said fingering pattern and a picture image showing said transposing musical instrument as fingered in said fingering pattern.

3. A fingering guide displaying apparatus according to claim 1, wherein said storage device stores said fingering pattern data to represent one or more fingering patterns for each available note of said transposing musical instrument, and wherein said display control device judges whether a plurality of fingering patterns are provided for one shifted note pitch of said identified note based on said fingering pattern data stored in said storage device, and, if a plurality of fingering patterns are provided for one shifted note pitch, causes said display device to display said plurality of fingering patterns represented by said fingering pattern data for said one shifted note pitch.

4. A fingering guide displaying apparatus according to claim 3, wherein, if a plurality of fingering patterns are provided for one shifted note pitch, said display control device prioritizes said plurality of fingering patterns for said one shifted note pitch according to a predetermined criterion and causes said display device to display said plurality of fingering patterns with the priority levels.

5. A fingering guide displaying apparatus according to claim 3, wherein, if a plurality of fingering patterns are provided for one shifted note pitch, said display control device selects one of said fingering patterns for said one shifted note pitch according to a predetermined criterion of selection and causes said display device to display thus selected fingering pattern for said one shifted note pitch.

6. A fingering guide displaying apparatus according to claim 1, further comprising an input device for inputting an instrument tonality of a transposing musical instrument; and wherein said storage device stores transposition data which represent for each of a plurality of instrument tonalities a pitch difference between said reference tonality and said each instrument tonality, and said note pitch shifting device reads out from said storage device the transposition data which represent said pitch difference with respect to said instrument tonality inputted from said input device.

7. A fingering guide displaying apparatus according to claim 1, further comprising a subsequent play note identifying device for identifying a subsequent note to be played subsequent to the note to be played at each said given time out of said group of notes represented by said music piece constituting note data; and wherein said display control device reads out from said storage device the fingering pattern data representing a fingering pattern which corresponds to the shifted note pitch obtained from said subsequent note by means of said note pitch shifting device, and causes said display device to display the fingering pattern corresponding to said shifted note pitch obtained from said subsequent note together with the fingering pattern corresponding to the shifted note pitch of the note at said given time.

8. A fingering guide displaying apparatus according to claim 1, further comprising a display time notifying device for notifying fingering pattern display times to display respective fingering patterns for the respective notes constituting said music piece, each of said fingering pattern display times being a time which precedes the time when each corresponding note is to be played by a predetermined amount of time; and wherein said display control device causes said display device to display the fingering pattern for said each corresponding note when said each fingering pattern display time is notified.

9. A fingering guide displaying apparatus according to claim 1, further comprising a tone signal generating device for generating musical tones successively according to the play progression of the music piece based on said music piece constituting data, and a play stop detecting device for detecting a stoppage of said play progression of the music piece; and wherein said display control device causes said display device to display said fingering pattern during the time at which said stoppage of the play progression of the music piece is being detected.

10. A fingering guide displaying apparatus comprising:

a display device;

a storage device for storing music piece constituting note data which represent a group of notes to constitute a music piece as expressed according to a nomenclature in a reference tonality, notational sign data which represent notational signs each indicating a playing manner of consecutive notes to be played as connected notes in said group of notes, and fingering pattern data which represent sets of standard fingering patterns and alternative fingering patterns, a set of a standard fingering pattern and at least one alternative fingering pattern being provided for each of available note pitches of a given musical instrument;

a play note identifying device for identifying notes to be played at respectively given times out of said group of notes represented by said music piece constituting note data, consecutive notes before and after the note at each said given time being identified in a set;

a connective note judging device for judging whether there is a notational sign connecting the note to be played at said given time with the preceding note or whether there is a notational sign connecting the note to be played at said given time with the succeeding note based on said notational sign data stored in said storage device;

a display control device for reading out from said storage device the fingering pattern data of said standard fingering pattern for the note to be played at said given time, if said connective note judging device judges there is not a notational sign connecting the consecutive notes at said given time, and for reading out the fingering pattern data of said alternative fingering pattern for the note to be played at said given time, if said connective note judging device judges there is a notational sign connecting the consecutive notes before and/or after the note at said given time, and causing said display device to display said fingering patterns represented by said read-out fingering pattern data.

11. A fingering guide displaying apparatus according to claim 10, wherein said storage device stores the fingering pattern data which represent a set of one standard fingering pattern and at least one alternative fingering pattern for each of available note pitches of said given musical instrument; and if said connective note judging device judges there is said notational sign, said display control device judges whether there are a plurality of alternative fingering patterns provided for the note to be played at said given time based on said fingering pattern data stored in said storage device, and if a plurality of alternative fingering patterns are provided for the note, prioritizes said plurality of alternative fingering patterns according to a predetermined criterion and causes said display device to display said plurality of fingering patterns with the priority levels.

12. A fingering guide displaying apparatus according to claim 10, wherein said storage device stores the fingering pattern data which represent a set of one standard fingering pattern and at least one alternative fingering pattern for each of available note pitches of said given musical instrument; and if said connective note judging device judges there is said notational sign, said display control device judges whether there are a plurality of alternative fingering patterns provided for the note to be played at said given time based on said fingering pattern data stored in said storage device, and if a plurality of alternative fingering patterns are provided for the note, selects one of said alternative fingering patterns according to a predetermined criterion of selection and causes said display device to display thus selected fingering pattern.

13. A fingering guide displaying apparatus comprising:

a display device;

a storage device for storing music piece constituting note data which represent a group of notes to constitute a music piece as expressed according to a nomenclature in a reference tonality, fingering pattern data which represent a set of one or more fingering patterns to play each of available note pitches of a given musical instrument, and physical condition data which quantitatively represent physical conditions of a given musical instrument when said musical instrument is played according to the fingering patterns indicated by said fingering pattern data, said physical conditions being provided in correspondence to said fingering patterns;

a play note identifying device for identifying a note to be played at a given time and its subsequent note out of said group of notes represented by said music piece constituting note data;

a play note fingering pattern identifying device for identifying one or more fingering patterns represented by said fingering pattern data stored in said storage device corresponding to the note to be played at said given time;

a subsequent note fingering pattern identifying device for identifying one or more fingering patterns represented by said fingering pattern data stored in said storage device corresponding to the subsequent note to be played subsequent to said given time;

a fingering pattern set determining device for determining a fingering pattern set by selecting a play note fingering pattern from among the fingering patterns as identified corresponding to said note to be played at said given time and a subsequent note fingering pattern from among the fingering patterns as identified corresponding to said subsequent note so that the difference between the physical condition at the selected play note fingering pattern and the physical condition at the selected subsequent note fingering pattern be minimal among other possible selections based on said physical condition data stored in said storage device; and a display control device for reading out from said storage device the fingering pattern data representing said determined set of the play note fingering pattern and the subsequent note fingering pattern, and causing said display device to display said determined set of fingering patterns successively along with the play progression of the music piece.

14. A fingering guide displaying apparatus according to any one of claims 1–13, wherein said music piece constituting note data represent a progression of a music piece in terms of a sequence of event data pieces of the constituting notes as expressed according to a nomenclature in a reference tonality, and said reference tonality is the key of C.

15. A computer readable medium containing executable instructions for causing a processor to perform a method for displaying a fingering guide for playing a musical instrument on an apparatus having a display device, and a storage device for storing music piece constituting note data which represent a group of notes to constitute a music piece as expressed according to a nomenclature in a reference tonality, transposition data which represent for at least one transposing musical instrument a pitch difference between said reference tonality and an instrument tonality which is unique to said transposing musical instrument, and fingering pattern data which represent fingering patterns for available notes of said transposing musical instrument as expressed in a nomenclature in said instrument tonality, said method comprising the steps of:

identifying notes to be played at respectively given times out of said group of notes represented by said music piece constituting note data;

reading out said transposition data from said storage device;

respectively transposing the pitches of said identified notes by the amount of said pitch difference represented by said transposition data to obtain respectively shifted note pitches which are expressed in the nomenclature in said instrument tonality and which are respectively identical with the pitches of said respectively identified notes as expressed in said reference tonality;

reading out from said storage device said fingering pattern data representing fingering patterns which respectively correspond to said shifted note pitches obtained by said transposing step; and causing said display device to display said fingering patterns represented by said read-out fingering pattern data.

16. A computer readable medium containing executable instructions for causing a processor to perform a method for displaying a fingering guide for playing a musical instrument on an apparatus having a display device, and a storage device for storing music piece constituting note data which represent a group of notes to constitute a music piece as expressed according to a nomenclature in a reference tonality, notational sign data which represent notational signs each indicating a playing manner of consecutive notes to be played as connected notes in said group of notes, and fingering pattern data which represent sets of standard fingering patterns and alternative fingering patterns, a set of a standard fingering pattern and at least one alternative fingering pattern being provided for each of available note pitches of a given musical instrument, said method comprising the steps of:

identifying notes to be played at respectively given times out of said group of notes represented by said music piece constituting note data, consecutive notes before and after the note at each said given time being identified in a set;

judging whether there is a notational sign connecting the note to be played at said given time with the preceding note or whether there is a notational sign connecting the note to be played at said given time with the succeeding note based on said notational sign data stored in said storage device;

reading out from said storage device the fingering pattern data of said standard fingering pattern for the note to be played at said given time, if said judging step judges there is not a notational sign connecting the consecutive notes at said given time, and for reading out the fingering pattern data of said alternative fingering pattern for the note to be played at said given time, if said judging step judges there is a notational sign connecting the consecutive notes before and/or after the note at said given time; and causing said display device to display said fingering patterns represented by said read-out fingering pattern data.

17. A computer readable medium containing executable instructions for causing a processor to perform a method for displaying a fingering guide for playing a musical instrument on an apparatus having a display device, and a storage device for storing music piece constituting note data which represent a group of notes to constitute a music piece as expressed according to a nomenclature in a reference tonality, fingering pattern data which represent a set of one or more fingering patterns to play each of available note pitches of a given musical instrument, and physical condition data which quantitatively represent physical conditions of a given musical instrument when said musical instrument is played according to the fingering patterns indicated by said fingering pattern data, said physical conditions being provided in correspondence to said fingering patterns, said method comprising the steps of:

identifying a note to be played at a given time and its subsequent note out of said group of notes represented by said music piece constituting note data;

identifying one or more fingering patterns represented by said fingering pattern data stored in said storage device corresponding to the note to be played at said given time;

identifying one or more fingering patterns represented by said fingering pattern data stored in said storage device corresponding to the subsequent note to be played subsequent to said given time;

determining a fingering pattern set by selecting a play note fingering pattern from among the fingering patterns as identified corresponding to said note to be played at said given time and a subsequent note fingering pattern from among the fingering patterns as identified corresponding to said subsequent note so that the difference between the physical condition at the selected play note fingering pattern and the physical condition at the selected subsequent note fingering pattern be minimal among other possible selections based on said physical condition data stored in said storage device;

reading out from said storage device the fingering pattern data representing said determined set of the play note fingering pattern and the subsequent note fingering pattern; and causing said display device to display said determined set of fingering patterns successively along with the play progression of the music piece.

* * * * *